US007179777B2

(12) United States Patent
Blokzijl et al.

(10) Patent No.: US 7,179,777 B2
(45) Date of Patent: Feb. 20, 2007

(54) LAUNDRY TREATMENT COMPOSITIONS COMPRISING A POLYMER WITH A CATIONIC AND POLYDIALKYLSILOXANE MOIETY

(75) Inventors: Wilfried Blokzijl, Bebington (GB); Robert John Carswell, Bebington (GB); Dominique Charmot, Campbell, CA (US); Robert Alan Hunter, Bebington (GB); Mingjun Liu, Santa Clara, CA (US); Paul Mansky, San Francisco, CA (US); Victor Nava-Salgado, San Jose, CA (US); Giovanni Francesco Unali, Bebington (GB)

(73) Assignee: Unilever Home & Personal Care USA Division of Conopco, Inc., Greenwich, CT (US)

( * ) Notice: Subject to any disclaimer, the term of this patent is extended or adjusted under 35 U.S.C. 154(b) by 205 days.

(21) Appl. No.: 10/328,059

(22) Filed: Dec. 23, 2002

(65) Prior Publication Data

US 2004/0121938 A1 Jun. 24, 2004

(51) Int. Cl.
*C11D 3/37* (2006.01)
*C11D 9/36* (2006.01)

(52) U.S. Cl. ..... 510/287; 510/276; 510/466; 510/504; 510/308; 510/322; 510/327; 510/330

(58) Field of Classification Search ..... 510/276, 510/466, 504, 287, 308, 322, 327, 330
See application file for complete search history.

(56) References Cited

U.S. PATENT DOCUMENTS

| | | | | |
|---|---|---|---|---|
| 4,246,423 A | | 1/1981 | Martin | |
| 4,384,130 A | * | 5/1983 | Martin | 556/418 |
| 4,394,378 A | * | 7/1983 | Klein | 514/63 |
| 4,395,454 A | * | 7/1983 | Baldwin | 442/118 |
| 4,448,810 A | * | 5/1984 | Westall | 427/302 |
| 4,504,541 A | * | 3/1985 | Yasuda et al. | 442/123 |
| 4,818,242 A | | 4/1989 | Burmeister et al. | |
| 4,986,922 A | * | 1/1991 | Snow et al. | 510/329 |
| 6,384,254 B1 | * | 5/2002 | Omura | 556/425 |
| 6,559,255 B2 | | 5/2003 | Klaerner et al. | |
| 6,607,717 B1 | * | 8/2003 | Johnson et al. | 424/70.12 |
| 2002/0068689 A1 | * | 6/2002 | Fender et al. | 510/511 |
| 2002/0120057 A1 | * | 8/2002 | Gosselink et al. | 524/588 |

FOREIGN PATENT DOCUMENTS

| | | | |
|---|---|---|---|
| DE | 10036522 | | 2/2002 |
| JP | 11-236485 | * | 8/1999 |
| JP | 2002-105434 | * | 4/2002 |
| WO | 00/24858 | * | 5/2000 |
| WO | 02/18528 | | 3/2002 |
| WO | 03/012020 | | 2/2003 |
| WO | 03/057813 | | 7/2003 |

OTHER PUBLICATIONS

U.S. Appl. No. 09/520,583, filed Mar. 8, 2000.
International Search Report, PCT/EP 03/13825, dated May 17, 2004—3 pp.
Benoit et al., "Development of a Universal Akloxyamine for 'Living' Free Radical Polymerizations," J. Am. Chem. Soc., 1999, 121 (16), pp. 3904-3920.

* cited by examiner

*Primary Examiner*—Charles Boyer
(74) *Attorney, Agent, or Firm*—Alan A. Bornstein

(57) ABSTRACT

A laundry treatment composition comprising at least one polymeric material comprising a cationic polymer moiety and a polydialkylsiloxane moiety, and at least one other component.

11 Claims, No Drawings

LAUNDRY TREATMENT COMPOSITIONS COMPRISING A POLYMER WITH A CATIONIC AND POLYDIALKYLSILOXANE MOIETY

TECHNICAL FIELD

The present invention relates to laundry treatment compositions comprising a modified silicone polymeric material and use of such a material to deposit on a substrate and thereby confer a benefit thereto.

BACKGROUND OF THE INVENTION

In laundry applications, silicone oils are commonly used in rinse conditioners formulation to bring additional benefit to the consumer such as a better sensory, antiwrinkle properties and ease of ironing. Materials of this type reduce the level of wrinkling by lubricating the fabric fibres, thereby lowering the fibre friction thus assisting the fabric in recovering from its wrinkled state. Similarly, an ease of iron effect is obtained by reducing the friction between the sole of the iron and the fabric surface. The usual kind of silicone is a polydimethyl siloxane (PDMS) or an aminosilicone, usually in emulsion form and is present at about 5% in the formulation. However, at present, it is difficult to deliver silicones from the main wash.

A mere silicone emulsion, e.g. stabilized with a non-ionic/anionic surfactant system does not show any deposition because of the lack of affinity of the silicone with the cotton surface. One way to improve the silicone uptake on the fabric is to emulsify with a cationic surfactant, as used in conventional rinse conditioner. In that case the positively charged silicone droplets interact with the mildly anionic cotton surface to form a coalesced film at the cotton surface. However, in main wash products cationic silicone emulsions cannot be used because the cationic sites are immediately neutralized by the surrounding anionic surfactant, causing the emulsion to collapse. This results in the partial depletion of the available anionic surfactant and consequently in a decrease of the cleansing efficiency. Moreover, if any silicone deposits at all on the cotton, its distribution is extremely heterogeneous.

The applicants have now found that certain silicone-containing graft or block cationic copolymers, when used as delivery aids in a washing composition, produce silicone emulsions that remain stable in presence of anionic surfactant and lead to high silicone deposition efficiency on a washing process.

DEFINITION OF THE INVENTION

A first aspect of the present invention provides a laundry treatment composition comprising at least one polymeric material comprising a cationic polymer moiety and a polysiloxane moiety, and at least one other component.

A second aspect of the present invention provides a method for depositing a polymer onto a substrate, the method comprising, contacting in an aqueous medium, the substrate and a composition according to the first aspect of the invention.

DETAILED DESCRIPTION OF THE INVENTION

When deposited on a fabric substrate, especially cotton, the polymeric materials of the present invention can endow one or more benefits conventionally obtainable from silicone-type ingredients, such as one or more of fabric softening, anti-wrinkle, anti-fuzzing, anti-piling and easy ironing.

The Polymeric Material

The polymeric material requires therein of a the polysiloxane moiety, a cationic polymer moiety and optionally, one or more other moieties such as neutral and/or anionic moieties.

The polymeric material is preferably chosen from those of formulae $(A\text{-}b\text{-}B)_n\text{-}A$ $(A\text{-}b\text{-}B)_n$ $A\text{-}g\text{-}(B)_n$ $(A\text{-}r\text{-}B)_n$ $(B\text{-}b\text{-}A)_n$ $B\text{-}g\text{-}(A)_n$ wherein:

A is a moiety that contains one or more cationic monomer units, preferably comprising from 5% to 100% more preferably from 20% to 100%, still more preferably from 35% to 100% by weight of cationic monomer units, and preferably comprised of between 5 and 500,000 monomer units, the balance of A comprising from 0% to 95%, preferably from 0% to 30% by weight of anionic monomer units and/or from 0% to 95%, preferably from 0% to 70% by weight of neutral monomer units, wherein the weight fraction of A is preferably from 5% to 95%, preferably from 60% to 95%, any balance being independently selected from one or more of anionic monomer units and/or cationic monomer units in block and/or random fashion.

B is a moiety which contains one or more siloxane monomer units;

n is from 1 to 300;

-b- indicates that A and B are connected via the termini of A and B respectively, so that for example when n=1, A-b-B-b-A is a triblock copolymer with B as the center block and A as the outer block;

-g- indicates that either A or B segment is attached anywhere pendant on the B or A block respectively; and -r- indicates that A and B are polymerised to form a random copolymer.

For instance when n=5, A-g-(B)n is a grafted copolymer with a backbone polymer A with 5 grafted pendant chains B, each A chain end being free from B chain.

These definitions also encompass the star coplymer where block A (resp. block B) radiate from a core polymer B (resp. polymer B);

For the avoidance of doubt, the moiety A must contain at least one cationic monomer unit, regardless of the amount of any anionic and/or neutral monomer units which may be present.

Cationic Monomers

A generalised representation of moieties can be represented by $$*\!-\!\!\left[D\right]_p\!-\!*$$

where each D is an independently selected monomer unit and p an integer comprised of from 5 to 500,000, and A preferably having between 5 mol. % to 100 mol. % of cationic monomers.

At least some of the cationic moieties A may be derived from a monomer of formula:

(I)

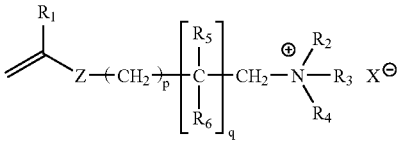

wherein $R_1$ is H or $CH_3$ $R_2$, $R_3$, $R_4$ are independently selected from linear or branched $C_1$–$C_6$ alkyl groups;

$R_5$, $R_6$ are independently H or $CH_3$;

P is from 0 to 3;

q is 0 or 1;

z is —(CO)O—, —C(O)NH—, or —O—; and $X^-$ is an appropriate counter ion.

The above monomer is shown quaternarized although it only becomes so when incorporated in the polymeric material. Nevertheless, the quaternary nitrogen is shown to indicate what will be the cationic moiety in the final product.

Preferred examples of such cationic monomers are 2-(dimethylamino)ethyl methacrylate, 2-(dimethylamino) ethyl acrylate, N-[3-(dimethylamino)propyl] methacrylamide, N-[3-dimethylamino)propyl] acrylamide, and 3-dimethylaminoneopentyl acrylate.

Other suitable cationic monomers include 1-vinylimidazole, vinylpyridine and (aryl-vinylbenzyl) trimethylammonium chlorides, and di:allyl-dialkyl ammonium chloride.

In general, suitable monomers may be rendered cationic by quaternerisation of the amine group after polymerisation with an appropriate quaternerisation agent such as $CH_3Cl$, $CH_3I$, or $(CH_3)_2SO_4$ At least some other suitable cationic monomers include those of formula:

(II)

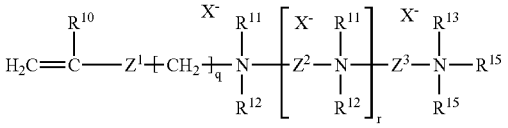

in which:

each $R^{10}$, $R^{11}$, $R^{12}$, $R^{13}$ and $R^{14}$ is independently selected from alkyl, hydroxylalkyl or aminoalkyl groups in which the alkyl moiety is a linear or branched $C_1$–$C_6$ chain, preferably methyl;

$R^{15}$ is hydrogen, methyl or ethyl;

q is from 0 to 10, preferably from 0 to 2;

r is from 1 to 6, preferably 2 to 4;

$Z^1$ is as defined for Z in formula (I);

$Z^2$ represents a $(CH_2)_s$ group, s being from 1 to 6, prefererably from 2 to 4;

$Z^3$ is a linear or branched $C_2$–$C_{12}$, advantageously $C_3$–$C_6$, polymethylene chain optionally interrupted by one or more heteroatoms or heterogroups, in particular O or NH, and optionally substituted by one or more hydroxyl or amino groups, preferably hydroxyl groups; and each $X^-$, is independently as defined in formula (I); and and also from ethylenically unsaturated monomers containing an aliphatic or aromatic cyclic moiety which contains a charged nitrogen ($N^+$) atom.

Preferred monomers of formula (II) are those wherein:

q is 2 or 3, especially 3;

r is from 0 to 2, more preferably 0 to 1, especially 0;

$Z^3$ is

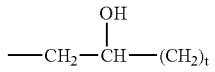

where t is from 1 to 4, preferably 1, and $R^{10}$ to $R^{14}$ which are the same or different, and represent a methyl or ethyl group.

Particularly preferred monomers of the latter type are those of following formula:

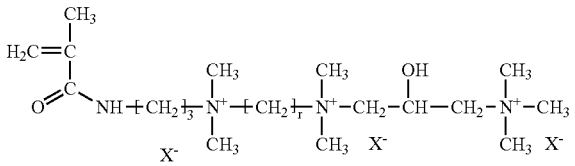

wherein r is from 2 to 4, and more particularly the monomer

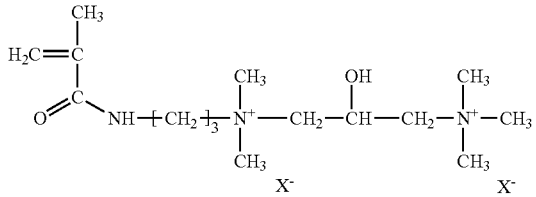

X-representing the chloride ion (Diquat)

Silicone Moieties

A generalised representation of moieties B may be given as

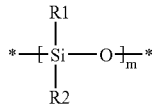

where R1 and R2 and indifferently H, alkyl or aryl groups, and m is an integer from 2 to 200, graft branched and hyperbranched polysiloxane analogues also being included, R1 or R2 optionally carrying cationic groups.

Silicone Monomers for Graft Polymers

Preferably, a silicone containing group as a graft or side chain is a monomer of formula

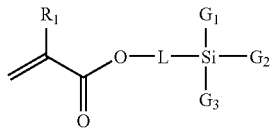

wherein L is a spacer group, for example $(CH_2)_n$, n being from 0 to 10, preferably 3;

$R_1$=H or $CH_3$;

one or both of $G_1$ to $G_3$ is $CH_3$, the remainder being selected from groups of formula

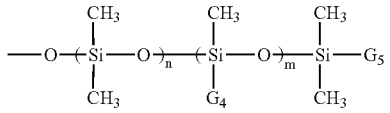

wherein the —$Si(CH_3)_2O$— groups and the —$Si(CH_30)(G^4)$- groups being arranged in random or block fashion, but preferably random;

n is from 5 to 1000, preferably from 5 to 200;

m is from 0 to 1000, preferably from 0 to 20, for example from 1 to 20;

$G^4$ is selected from groups of formula:

—$(CH_2)_p$—$CH_3$, where p is from 1 to 18

—$(CH_2)_q$—NH—$(CH_2)_r$—$NH_2$ where q and r are independently from 1 to 3

—$(CH_2)_s$—$NH_2$, where s is from 1 to 3

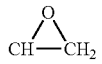

—$(CH_2)_t$— where t is from 1 to 3

—$(CH_2)_u$—COOH, where u is from 1 to 10, where v is from 1 to 10, and

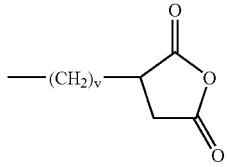

—$(CH_2CH_2O)_w$—$(CH_2O)_xH$, where w is from 1 to 150, preferably from 10 to 20 and x is from 0 to 10;

—$(CH_2)_x$—$(CH_2CH_2O)_wH$, where x is from 0 to 10, w is from 1 to 150 preferably from 1 to 20.

and $G^5$ is independently selected from hydrogen, groups defined above for $G^4$, —OH, —$CH_3$ and —$C(CH_3)_3$.

Preferred silicone monomer for this purpose is Monomethacryloxypropyl terminated polydimethylsiloxane, $M_n$=900–10,000 $gmol^{-1}$ Silicone Monomers for Block Copolymers A preferred class of monomers for use as blocks in the polymeric material have the formula:

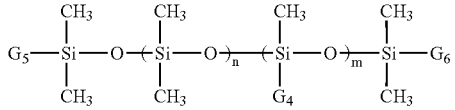

wherein $G_5$ and $G_6$ each are independently selected from hydrogen, groups defined above for $G_4$, —OH, —$CH_3$, —$C(CH_3)_3$ and —$(CH_2)_x$—$(CH_2CH_2O)_w$—H;

m and n are as hereinbefore defined;

x is from 0 to 10 and w is from 1 to 150 preferably from 1 to 20;

such that one or both of $G_5$ and/or $G_6$ can react with a control transfer agent (CTA) to initiate a living free radical polymerisation.

Preferred such silicone monomers are mono hydroxy terminated Polydimethylsiloxane, dihydroxy terminated Polydimethyl siloxane, mono amino terminated polydimethyl siloxane, and diamino terminated polydimethyl siloxane and preferably having a n average number molecular weight (Mn) in the range 1000–10,000 $gmol^{-1}$.

Neutral (Uncharged) Monomers

Optionally, one or more neutral (uncharged) moieties may be included in any part of the polymeric material.

Preferably, the uncharged monomer units used to create such moieties are derived from ethyenically unsaturated monomers, suitably selected from one or more hydrophilic neutral monomers such as (meth)acrylamide and their N-monosubstituted or N,N-disubstituted versions.(such as N-isopropylacrylamide, N-tris (hydroxymethyl)methyl acrylamide, N-butylacrylamide and N,N-dimethylacrylamide), vinyl formamide, vinyl pyrrolidone, alkoxylated (meth)acrylate, such as hydroxyethyl(meth)acrylate, hydroxypropyl(meth)acrylate, and their higher ethoxylated or propoxylated versions, of the formula (V):

(V)

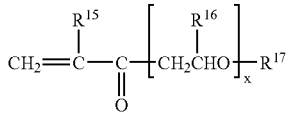

wherein $R^{15}$ is hydrogen, or methyl and $R^{16}$ is hydrogen, methyl or ethyl, $R^{17}$ is —H or —$CH_3$ and X is from 1 to 150;

Anionic Monomers

Optionally, one or more anionic moieties may also be included in any part of the polymeric material.

The anionic monomer which may be used to form such anionic moieties are preferably selected from one or more units derived from ethylenically unsaturated monomers having at least one anionic group. Typical such monomers have the general formula (A)

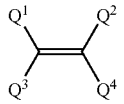

(A)

wherein at least two of $Q^1$–$Q^4$ are independently selected from hydrogen and methyl;

either one or two of $Q^1$–$Q^4$ are independently selected from anionic groups, preferably of formula:

$-Q^5-Q^6-Y$ wherein either or both of $Q^5$ and $Q^6$ is/are absent, $Q^5$ otherwise representing -Ph-, —CO—, —$CH_2$=$CH_2$, —CONH— or —CO—O— and $Q^6$ otherwise representing a $C_{1-4}$ alkylene linkage, one or more of the hydrogen atoms of which is independently optionally substituted by an —OH group or a group —Y;

Y is selected from groups of formula —$CO_2H$, —$SO_3H$, —$OSO_3H$, —$PO_4H$, —$PO_3H$, —$OPO_3H_2$ and —$OPO_3H_3$;

and in the case where two only of $Q^1$–$Q^4$ are independently hydrogen or methyl and only one of $Q^1$–$Q^4$ is -$Q^5$–$Q^6$-Y, then the remaining group of $Q^1$–$Q^4$ can be any other compatible uncharged group, for example aliphatic, aromatic or mixed aliphatic-aromatic groups having from 2 to 20 carbon atoms (optionally also containing one or more heteroatoms) such as $C_{2-20}$ alkyl groups, $C_{5-12}$ cycloalkyl groups, $C_{5-9}$ aryl groups, $C_{1-8}$ alkyl-$C_{5-9}$ aryl groups, any cycloalkyl or aryl group optionally containing one or two heteroatoms independently selected from nitrogen, oxygen and sulphur.

Preferred anionic groups for the anionic monomer units (whether or not derived from monomers of formula (A)) are selected from —$CO_2H$, —$SO_3H$, —$OSO_3H$, —$CH_2OSO_3H$, —CH=$CHSO_3H$ and groups of formula —$(CO)_p$—$CH_2$—$CQ^7Q^8CO_2H$, —$PO_4H$, —$PO_3H$, —$OPO_3H_2$, —$OPO_3H_3$, wherein p is 0 or 1, $Q^7$ is selected from H and OH and $Q^8$ is selected from H and $CO_2H$; and salts thereof.

A non-limiting list of suitable ethylenically unsaturated anionic monomers includes acrylic acid, methacrylic acid, α-ethacrylic acid, β,β-dimethylacrylic acid, methylenemalonic acid, vinylacetic acid, allylacetic acid, ethylideneacetic acid, propylideneacetic acid, crotonic acid, maleic acid or anhydride, fumaric acid, itaconic acid, citraconic acid, mesaconic acid, N-(methacryloyl)alanine, mono-2-(methacryloyl)ethyl succinate, 2-acrylamido-2-methyl-1-propane sulphuric acid, 2-acrylamido glycolic acid, sulphopropyl acrylate, sulphoethyl acrylate, sulphoethyl methacrylate, styrenesulphonic acid, vinylsulphonic acid, 2-sulphoethyl methacrylate, sodium allyloxy hydrooxypropyl sulphonate, vinylphosphonic acid, phosphoethyl acrylate, phosphonoethyl acrylate, phosphopropyl acrylate, phosphonopropyl acrylate, phosphoethyl methacrylate, phosphonoethyl methacrylate, phosphopropyl methacrylate, phophonopropyl methacrylate, ethyleneglycol methacrylate phophate, sulphate of alkoxylate (meth)acrylate, and salts thereof.

Any reference herein to an alkyl group on its own or as part of another group includes reference to straight and branched forms thereof.

Any anionic group forming part of an anionic monomer starting material or anionic monomer unit of the polymer may be in the acid form or salt form. Often, the free acid form may be neutralised either as part of the process for forming the polymer or when the polymer is incorporated in the detergent composition. Suitable counter-cations of the salt forms are alkali metals such as sodium or potassium, alkaline earth metals such as magnesium or organic ions such as $NH_4^+$.

Synthetic Routes

In the aforementioned general formulae, the moiety A can be obtained by any polymerization process, such as free radical polymerisation, ring opening polymerisation, modification of natural polymers such as polysaccharides, and polycondensations to name a few.

In one embodiment, the polymeric material is prepared by free radical polymerization. There are several ways in which free radical polymerisation can be used. For example, for polymerizing graft copolymers, there are several options, including using the "grafting from", "grafting onto" or "grafting through" approach. In the "grafting from" approach, the grafted chains are grown from the backbone onwards by e.g. creating grafting or initiating sites on the backbone. With the "grafting onto" approach, the preformed pendant chains are reacted onto the backbone. The "grafting through" method occurs when a macromonomer is used and copolymerized with the monomers that compose the backbone polymer. The latter technique is preferred for the preferred structure A-g-$(B)_n$. In that case a preformed polydialkylsiloxane macromonomer B, having at one chain end a copolymerizable double bond, is polymerized together with the monomers constituting A.

Block copolymers of the present invention can be prepared by several ways, such as chemical coupling of segments A and B through reactive groups located at the A and B termini, or polymerization of the A block initiated from B terminus moiety.

When the latter route is used, living free radical polymerization is one way to make the block copolymers of the present invention. One example of this type of process comprises:

a) activating the backbone B by attaching a control agent XY at one or both ends of B;

b) carrying out a living (controlled) radical polymerization to grow the chain A from the initiating site XY; and c) optionally chemically modifying the polymer to bring the cationic sites on the A blocks.

In some embodiments, the copolymers of this invention are prepared, at least in part, using a living-type polymerization reaction. In these embodiments, for example, an initiator and, optionally, a control agent are combined with one or more preformed macromonomers that comprise the B block. For block copolymers, the control agent is added to at least one derivatized terminus of the B block. For graft copolymers, the control agent can be added to derivitized portions of the backbone comprising the B moiety. The monomers that comprise the A block are then added to form a polymerization mixture, which is then subjected to or is under polymerization conditions causing a polymerization reaction. The A block or graft (depending on the location of the control agent on the B moiety) is then grown to a desired point (e.g., molecular weight or degree of polymerization).

Ideally, the growth of the A block occurs with high conversion. Conversions are determined by NMR via integration of polymer to monomer signals. Conversions may also be determined by size exclusion chromatography (SEC)

via integration of polymer to monomer peak. For UV detection, the polymer response factor must be determined for each polymer/monomer polymerization mixture. Typical conversions can be 50% to 100% for the A block, more specifically in the range of from about 60% to about 90%).

Hawker et al., "Development of a Universal Alkoxyamine for 'Living' Free Radical Polymerizations," *J. Am. Chem. Soc.,* 1999, 121(16), pp. 3904–3920 discloses a nitroxide mediated processes that may be used herein. Also, polymerization processes disclosed in U.S. patent application Ser. No. 09/520,583, filed Mar. 8, 2000 and corresponding international application PCT/US00/06176 are particularly preferred, and both of these applications are incorporated herein by reference.

Generally, the polymerization proceeds under polymerization conditions. Polymerization conditions include the ratios of starting materials, temperature, pressure, atmosphere and reaction time. The polymerization conditions that may be used for nitroxide mediated living type free radical polymerization include: Temperatures for polymerization are typically in the range of from about 80° C. to about 130° C., more preferably in the range of from about 95° C. to about 130° C. and even more preferably in the range of from about 120° C. to about 130° C. The atmosphere may be controlled, with an inert atmosphere being preferred, such as nitrogen or argon. The molecular weight of the polymer can be controlled via controlled free radical polymerization techniques or by controlling the ratio of monomer to initiator. Generally, the ratio of monomer to initiator is in the range of from about 200 to about 800. In a nitroxide radical controlled polymerization the ratio of control agent to initiator can be in the range of from about 1 mol % to about 10 mol % is preferred. The polymerization may be carried out in bulk or in a suitable solvent such as diglyme. Polymerization reaction time may be in the range of from about 0.5 hours to about 72 hours, preferably from about 1 hour to about 24 hours and more preferably from about 2 hours to about 12 hours. When radical additional fragmentation transfer (RAFT) living polymerization is implementeed, the polymerization conditions that may be used include temperatures for polymerization typically in the range of from about 20° C. to about 110° C., more preferably in the range of from about 50° C. to about 90° C. and even more preferably in the range of from about 70° C. to about 85° C. The atmosphere may be controlled, with an inert atmosphere being preferred, such as nitrogen or argon. The molecular weight of the polymer is controlled via adjusting the ratio of monomer to control agent.

When a RAFT-type technique is used, the control agent is defined as

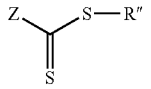

, discussed below. Generally, with RAFT the ratio of monomer to control agent is in the range of from about 200 to about 800. A free radical initiator is usually added to the reaction mixture, so as to maintain the polymerization rate to an acceptable level. Conversely, a too high free radical initiator to control agent ratio will favor unwanted dead polymer formation, namely pure homopolymers or block copolymers of unknown composition. The molar ratio of free radical initiator to control agent for polymerization are typically in the range of from about 2:1 to about 0.02:1.

Initiators in the RAFT process that may be used are known in the art, and may be selected from the group consisting of alkyl peroxides, substituted alkyl peroxides, aryl peroxides, substituted aryl peroxides, acyl peroxides, alkyl hydroperoxides, substituted alkyl hydroperoxides, aryl hydroperoxides, substituted aryl hydroperoxides, heteroalkyl peroxides, substituted heteroalkyl peroxides, heteroalkyl hydroperoxides, substituted heteroalkyl hydroperoxides, heteroaryl peroxides, substituted heteroaryl peroxides, heteroaryl hydroperoxides, substituted heteroaryl hydroperoxides, alkyl peresters, substituted alkyl peresters, aryl peresters, substituted aryl peresters, and azo compounds. Specific initiators include BPO and AIBN. The reaction media for these polymerization reactions is either an organic solvent or bulk monomer or neat. Optionally, the dithio moiety of the control agent can be cleaved by chemical or thermal ways, if one wants to reduce the sulfur content of the polymer and prevent any problems associated with presence of the control agents chain ends, such as odor or discoloration. Typical chemical treatment include the catalytic or stochiometric addition of base such as a primary amine, acid or anhydride, or oxydizing agents such as hypochloride salts.

When living free radical polymerization is used, the RAFT process is one method that can be used, and more particularly RAFT processes using chain transfer agent of the dithio type, such as dithioesters, dithiocarbonates and dithiocarbamates, trithiocarbonates and dithiocarbazates can be utilized.

Typically, the agent must be able to be expelled as or support a free radical. In some embodiments, the control agent, Y, is characterized by the general formula:

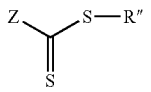

where Z is any group that activates the C═S double bond towards a reversible free radical addition fragmentation reaction and R" is selected from the group consisting of, generally, any group that can be easily expelled under its free radical form (R'•) upon an addition-fragmentation reaction. This control agent can be attached to the B block through either Z or R", however, for ease these groups are discussed below in terms as if they are not the linking group to the B block (thus, e.g., alkyl would actually be alkylene). R" is generally selected from the group consisting of optionally substituted hydrocarbyl, and heteroatom-containing hydrocarbyl. More specifically, R" is selected from the group consisting of optionally substituted alkyl, aryl, alkenyl, alkoxy, heterocyclyl, alkylthio, amino and polymer chains. And still more specifically, R" is selected from the group consisting of —$CH_2Ph$, —$CH(CH_3)CO_2CH_2CH_3$, —$CH(CO_2CH_2CH_3)_2$, —$C(CH_3)_2CN$, —CH(Ph)CN and —$C(CH_3)_2Ph$.

Z is typically selected from the group consisting of hydrocarbyl, substituted hydrocarbyl, heteroatom-containing hydrocarbyl and substituted heteroatom containing hydrocarbyl. More specifically, Z is selected from the group consisting of optionally substituted alkyl, aryl, heteroaryl and most preferably is selected from the group consisting of amino and alkoxy.

In other embodiments, Z is attached to C═S through a carbon atom (dithioesters), a nitrogen atom (dithiocarbamate), two nitrogen atoms in series (dithiocarbazate), a sulfur atom (trithiocarbonate) or an oxygen atom (dithiocarbonate). Specific examples for Z can be found in WO 98/01478, WO99/35177, WO99/31144, WO98/58974, U.S. Pat. No. 6,153,705, and U.S. patent application Ser. No. 09/676,267, filed Sep. 28, 2000, each of which is incorporated herein by reference. Particularly preferred control agents of the type in formula II are those where the control agent is attached through R" and Z is either, a carbazate, —$OCH_2CH_3$ or pyrrole attached via the nitrogen atom. As discussed below, linker molecules can be present to attach the C═S group to the B block through Z or R".

One possible route to silicone block copolymers of the invention is to chemically link a mono end functional polydimethylsiloxane (PDMS) with the R group of the CTA. This can be done for instance by first derivatizing the R group with an electrophile such as isocyanate, epoxy of acid chloride, and coupling with the PDMS block bearing a nucleophile at its one terminus, the latter being an amine or an alcohol group. The PDMS-CTA adduct is then subjected to living free radical polymerization to extend the chain with a cationic copolymers, by insertion of the monomer units between the PDMS and the CTA moiety. Optionaly the dithio group is then disposed of by chemical or thermal cleavage.

In other embodiments an initiator-control agent adduct is used. The control agent may be a nitroxide radical. Broadly, the nitroxide radical control agent may be characterized by the general formula —O—$NR^5R^6$, wherein each of $R^5$ and $R^6$ is independently selected from the group of hydrocarbyl, substituted hydrocarbyl, heteroatom containing hydrocarbyl and substituted heteroatom containing hydrocarbyl; and optionally $R^5$ and $R^6$ are joined together in a ring structure. In a more specific embodiment, the control agent may be characterized by the general formula:

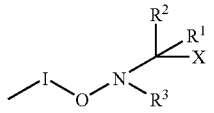

where I is a residue capable of initiating a free radical polymerization upon homolytic cleavage of the I-O bond, the I residue being selected from the group consisting of fragments derived from a free radical initiator, alkyl, substituted alkyl, alkoxy, substituted alkoxy, aryl, substituted aryl, and combinations thereof; X is a moiety that is capable of destabilizing the control agent on a polymerization time scale; and each $R^1$ and $R^2$, independently, is selected from the group consisting of alkyl, substituted alkyl, cycloalkyl, substituted cycloalkyl, heteroalkyl, heterocycloalkyl, substituted heterocycloalkyl, aryl, substituted aryl, heteroaryl, substituted heteroaryl, alkoxy, aryloxy, silyl, boryl, phosphino, amino, thio, seleno, and combinations thereof; and $R^3$ is selected from the group consisting of tertiary alkyl, substituted tertiary alkyl, aryl, substituted aryl, tertiary cycloalkyl, substituted tertiary cycloalkyl, tertiary heteroalkyl, tertiary heterocycloalkyl, substituted tertiary heterocycloalkyl, heteroaryl, substituted heteroaryl, alkoxy, aryloxy and silyl. Preferably, X is hydrogen.

Synthesis of the types of initiator-control agents in the above formula is disclosed in, for example, Hawker et al., "Development of a Universal Alkoxyamine for 'Living' Free Radical Polymerizations," *J. Am. Chem. Soc.,* 1999, 121 (16), pp. 3904–3920 and U.S. patent application Ser. No. 09/520,583, filed Mar. 8, 2000 and corresponding international application PCT/US00/06176, all of which are incorporated herein by reference.

The polymers of the invention can be either soluble or dispersible in water. The solubility of the polymer can also be aided by the addition of surface active materials: for instance non-ionic surfactants are useful to solubilize (comicellize) the block and graft copolymers of the invention, as well as to provide a good compatibility of said polymers with washing formulations containing anionic surfactants. Solubilisation is also facilited with the use of high shear homogeneizers.

Compositions

The polymeric material is incorporated together with one or more other components into laundry treatment compositions. For example, such a composition may optionally also comprise only a diluent (which may comprise solid and/or liquid) and/or also it may comprise an active ingredient. The polymeric material is typically included in said compositions at levels of from 0.001% to 10% by weight, preferably from 0.025% to 5%, more preferably from 0.01% to 3%. However, as will be explained in more detail herein below, the polymeric material may be incorporated in the form of a silicone emulsion.

The active ingredient in the compositions is preferably a surface active agent or a fabric conditioning agent. More than one active ingredient may be included. For some applications a mixture of active ingredients may be used. Although the compositions of the invention are preferably wash compositions, especially those containing anionic surfactant, rinse compositions are not excluded.

The compositions of the invention may be in any physical form e.g. a solid such as a powder or granules, a tablet, a solid bar, a paste, gel or liquid, especially, an aqueous based liquid. In particular the compositions may be used in laundry compositions, especially in liquid, powder or tablet laundry composition.

The compositions of the present invention are preferably laundry compositions, especially main wash (fabric washing) compositions or rinse-added softening compositions. The main wash compositions may include a fabric softening agent and rinse-added fabric softening compositions may include surface-active compounds, particularly non-ionic surface-active compounds, if appropriate.

Emulsions

The polymers of the invention are either soluble or dispersible in water. The solubility of the polymer can also be aided by the addition of surface active materials: for instance non-ionic surfactants are useful to solubilize (comicellize) the block and graft copolymers of the invention, as well as to provide a good compatibility of said polymers with washing formulations containing anionic surfactants. Solubilisation is also facilited with the use of high shear homogeneizers.

These materials prove to be efficient in dispersing polysiloxane oils as stable emulsions, said emulsions being compatible (i.e not showing any signs of coagulation) with washing liquors. These polymers also demonstrate unexpectedly good silicone oil deposition efficiency on cotton fabric, under washing conditions.

Therefore the polymeric material may be provided in the form of an emulsion with a silicone, for use in laundry treatment compositions.

The emulsion must contain another liquid component as well as the silicone, preferably a polar solvent, such as water. The emulsion has typically 30 to 99.9%, preferably 40 to 99% of the other liquid component (eg water). Low water emulsions may be for example 30 to 60% water, preferably 40 to 55% water. High water emulsions may be for example 60 to 99.9% water, preferably 80 to 99% water. Moderate water emulsions may be for example 55 to 80% water.

The emulsion may contain an emulsifying agent, preferably an emulsifying surfactant for the silicone and polymeric material. The emulsifying agent is especially one or more surfactants, for example, selected from any class, sub class or specific surfactant(s) disclosed herein in any context. The emulsifying agent most preferably comprises or consists of a non-ionic surfactant. Additionally or alternatively, one or more selected additional surfactants from anionic, cationic, zwitterionic and amphoteric surfactants may be incorporated in or used as the emulsifiying agent.

Suitable non-ionic surfactants include the (poly)alkoxylated analogues of saturated or unsaturated fatty alcohols, for example, having from 8 to 22, preferably from 9 to 18, more preferably from 10 to 15 carbon atoms on average in the hydrocarbon chain thereof and preferably on average from 3 to 11, more preferably from 4 to 9 alkyleneoxy groups. Most preferably, the alkyleneoxy groups are independently selected from ethyleneoxy, propyleneoxy and butylenoxy, especially ethyleneoxy and propylenoxy, or solely ethyleneoxy groups and alkyl polyglucosides as disclosed in EP 0 495 176.

Preferably, the (poly)alkoxylated analogues of saturated or unsaturated fatty alcohols, have a hydrophilic-lipophilic balance (HLB) of between 8 to 18. The HLB of a polyethoxylated primary alcohol nonionic surfactant can be calculated by $$HLB = \frac{MW\ (EO)}{MW\ (TOT) \times 5} \times 100$$

where

MW (EO)=the molecular weight of the hydrophilic part (based on the avverage number of EO groups)

MW(TOT)=the molecular weight of the whole surfactant (based on the average chain length of the hydrocarbon chain)

This is the classical HLB calculation according to Griffin (J. Soc. Cosmentic Chemists, 5 (1954) 249–256).

For analogous nonionics with a mix of ethyleneoxy (EO), propylenoxy (PO) and/or butyleneoxy (BO) hydrophilic groups, the following formula can be used;

$$HLB = \frac{MW(EO) + 0.57\,MW(PO) + 0.4\ MW(BO)}{MW\ (TOT) \times 5}$$

Preferably, the alkyl polyglucosides may have the following formula;

$$R—O-Z_n$$

in which R is a linear or branched, saturated or unsaturated aliphatic alkyl radical having 8 to 18 carbon atoms or mixtures thereof, and $Z_n$ is a polyglycosyl radical with n=1.0 to 1.4 hexose or pentose units or mixtures. Preferred examples of alkylpolyglucosides include Glucopon™.

Whether in a composition of a component (especially an emulsion) to be incorporated in a laundry treatment composition as a whole, the weight ratio of silicone to the polymeric material is preferably from 1:1 to 100:1, more preferably from 5:1 to 20:1. The weight ratio of the polymeric material to emulsifying agent is from 1:2 to 100:1, preferably 2:1 to 10:1. Further, in any such composition (especially emulsion components) the weight ratio of silicone to emulsifying agent is from 100:1 to 2:1, preferably from 50:1 to 5:1, more preferably from 20:1 to 7:1.

Preferably, the total amount of silicone is from 50 to 95%, preferably from 60 to 90%, more preferably from 70 to 85% by weight of the polymeric material, silicone and any emulsifying agent.

Emulsion Processing

When in the form of an emulsion, the emulsion is prepared by mixing the silicone, polymeric material, other liquid component (eg water) and preferably, also an emulsifying agent, such as a surfactant, especially a non-ionic surfactant, e.g. in a high shear mixer.

Whether or not pre-emulsified, the silicone and the polymeric material may be incorporated by admixture with other components of a laundry treatment composition. Preferably, the emulsion is present at a level of from 0.0001 to 40%, more preferably from 0.001 to 30%, even more preferably from 0.1 to 20%, especially from 1 to 15% and for example from 1 to 5% by weight of the total composition.

The Optional Silicone for Emulsification

Silicones are conventionally incorporated in laundry treatment (e.g. wash or rinse) compositions to endow anti-foam, fabric softening, ease of ironing, anti-crease and other benefits. Any type of silicone can be used to impart the lubricating property of the present invention however, some silicones and mixtures of silicones are more preferred.

Typical inclusion levels are from 0.01% to 25%, preferably from 0.1% to 5% of silicone by weight of the total composition.

Suitable silicones include:

non-volatile silicone fluids, such as poly(di)alkyl siloxanes, especially polydimethyl siloxanes and carboxylated or ethoxylated varients. They may be branched, partially cross-linked or preferably linear.

aminosilicones, comprising any organosilicone having amine functionality for example as disclosed in EP-A-459 821, EP-A-459 822 and WO 02/29152. They may be branched, partially cross-linked or preferably linear.

any organosilicone of formula H-SXC where SXC is any such group hereinafter defined, and derivatives thereof.

reactive silicones and phenyl silicones

The choice of molecular weight of the silicones is mainly determined by processability factors. However, the molecular weight of silicones is usually indicated by reference to the viscosity of the material. Preferably, the silicones are liquid and typically have a viscosity in the range 20 cStokes to 300,000 cStokes. Suitable silicones include dimethyl, methyl (aminoethylaminoisobutyl) siloxane, typically having a viscosity of from 100 cStokes to 200 cStokes with an average amine content of ca. 2mol % and, for example, Rhodorsil Oil 21645, Rhodorsil Oil Extrasoft and Wacker Finish 1300.

More specifically, materials such as polyalkyl or polyaryl silicones with the following structure can be used:

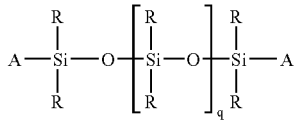

The alkyl or aryl groups substituted on the siloxane chain (R) or at the ends of the siloxane chains (A) can have any structure as long as the resulting silicones remain fluid at room temperature.

R preferably represents a phenyl, a hydroxy, an alkyl or an aryl group. The two R groups on the silicone atom can represent the same group or different groups. More preferably, the two R groups represent the same group preferably, a methyl, an ethyl, a propyl, a phenyl or a hydroxy group. "q" is preferably an integer from about 7 to about 8,000. "A" represents groups which block the ends of the silicone chains. Suitable A groups include hydrogen, methyl, methoxy, ethoxy, hydroxy, propoxy, and aryloxy.

Preferred alkylsiloxanes include polydimethyl siloxanes having a viscosity of greater than about 10,000 centistokes (cst) at 25OC; and a most preferred silicone is a reactive silicone, i.e. where A is an OH group.

Suitable methods for preparing these silicone materials are disclosed in U.S. Pat. Nos. 2,826,551 and 3,964,500.

Other useful silicone materials include materials of the formula:

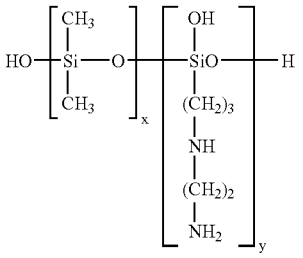

wherein x and y are integers which depend on the molecular weight of the silicone, the viscosity being from about 10,000 (cst) to about 500,000 (cst) at 25° C. This material is also known as "amodimethicone".

Other silicone materials which can be used, correspond to the formulae:

$$(R^1)_aG_{3-a}\text{-Si}—(—OSiG_2)_n—(OSiG_b(R^1)_{2-b})_m—O—SiG_{3-a}(R^1)_a$$

wherein G is selected from the group consisting of hydrogen, phenyl, OH, and/or $C_{1-8}$ alkyl; a denotes 0 or an integer from 1 to 3; b denotes 0 or 1; the sum of n+m is a number from 1 to about 2,000; $R^1$ is a monovalent radical of formula $CpH_2pL$ in which p is an integer from 2 to 8 and L is selected from the group consisting of

—$N(R^2)CH_2$—$CH_2$—$N(R^2)_2$;

—$N(R^2)_2$;

—$N^+(R^2)_3A^-$; and

—$N^+(R^2)CH_2$—$CH_2N^+H_2A^-$ wherein each $R^2$ is chosen from the group consisting of hydrogen, phenyl, benzyl, a saturated hydrocarbon radical, and each $A^-$ denotes a compatible anion, e.g. a halide ion; and

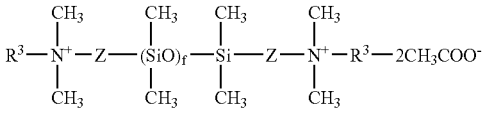

wherein

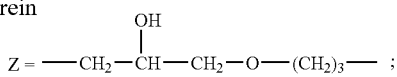

$R^3$ denotes a long chain alkyl group; and f denotes an integer of at least about 2.

Another silicone material which can be used, has the formula:

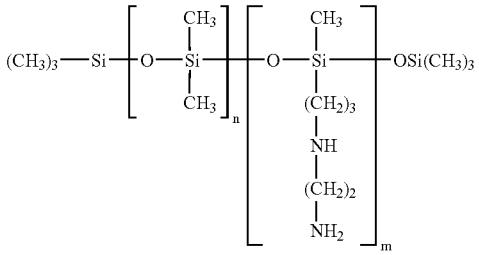

wherein n and m are the same as before.

Other suitable silicones comprise linear, cyclic, or three-dimensional polyorganosiloxanes of formula (I)

(I)

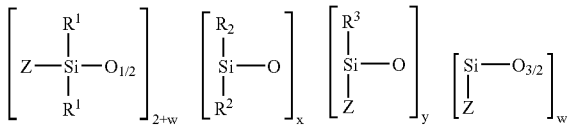

wherein (1) the symbols Z are identical or different, represent $R^1$, and/or V;

(2) $R^1$, $R^2$ and $R^3$ are identical or different and represent a monovalent hydrocarbon radical chosen from the linear or branched alkyl radicals having 1 to 4 carbon atoms, the linear or branched alkoxy radicals having 1 to 4 carbon atoms, a phenyl radical, preferably a hydroxy radical, an ethoxy radical, a methoxy radical or a methyl radical; and (3) the symbols V represent a group of sterically hindered piperidinyl functions chosen from (II)

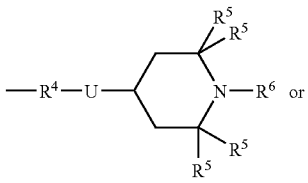

(III)

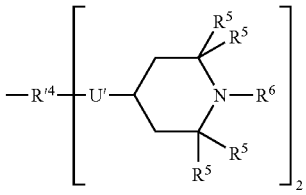

For the groups of formula II (II)

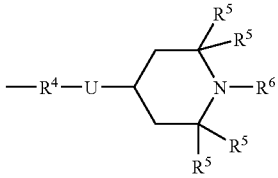

$R^4$ is a divalent hydrocarbon radical chosen from linear or branched alkylene radical, having 2 to 18 carbon atoms;

linear or branched alkylene-carbonyl radical where the alkylene part is linear or branched, comprising 2 to 20 carbon atoms;

linear or branched alkylene-cycolhexylene where the alkylene part is linear or branched, comprising 2 to 12 carbon atoms and the cyclohexylene comprises an OH group and possibly 1 or 2 alkyl radicals having 1 to 4 carbon atoms;

the radicals of the formula —$R^7$—O—$R^7$ where the $R^7$ radical is identical or different represents an alkylene radical having 1 to 12 carbon atoms;

the radicals of the formula —$R^7$—O—$R^7$ where the $R^7$ radical is as indicated previously and one or both are substituted by one or two OH groups;

the radicals of the formula —$R^7$—COO—$R^7$ where the —$R^7$ radicals are as indicated previously;

the radicals of formula $R^8$—O—$R^9$—O—CO—$R^8$ where the $R^8$ and $R^9$ radicals are identical or different, represent alkylene radicals and have 2 to 12 carbon atoms and the radical $R^9$ is possibly substituted with a hydroxyl radical;

U represents —O— or —$NR^{10}$—, $R^{10}$ is a radical chosen from a hydrogen atom, a linear or branched alkyl radical comprising 1 to 6 carbon atoms and a divalent radical of the formula:

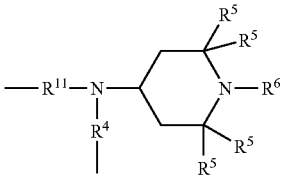

where $R^4$ is as indicated previously, $R^5$ and $R^6$ have the meaning indicated below et $R^{11}$ represents a divalent alkylene radical, linear or branched, having 1 to 12 carbon atoms, one of the valent bonds (one of $R^{11}$) is connnected to an atom of —$NR^{10}$—, the other (one of $R^4$) is connected to a silicone atom;

the radical $R^5$ is identical or different, chosen from the linear or branched alkyl radicals having 1 to 3 carbon atoms and the phenyl radical;

the radical $R^6$ represents a hydrogen radical or the $R^5$ radical or O.

For the groups of formula (III):

(III)

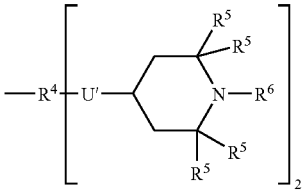

$R'^4$ is chosen from a trivalent radical of the formula:

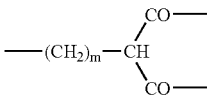

where m represents a number between 2 and 20, and a trivalent radical of the formula:

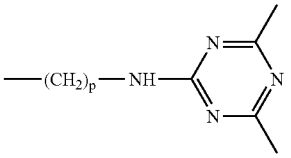

where p represents a number between 2 and 20;

U represents —O— or $NR^{12}$, $R^{12}$ is a radical chosen from a hydrogen atom, a linear or branched alkyl radical comprising 1 to 6 carbon atoms;

$R^5$ and $R^6$ have the same meaning as proposed for formula (II); and (4)—the number of units ηSi without group V comprises between 10 and 450 the number of units ηSi with group V comprises between 1 and 5, $0 \leqq w \leqq 10$ and $8 \leqq y \leqq 448$.

Other Components

The detergent compositions of the invention may contain a surface-active compound (surfactant) which may be chosen from soap and non-soap anionic, cationic, non-ionic, amphoteric and zwitterionic surface-active compounds and mixtures thereof. Many suitable surface-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap anionic and non-ionic compounds.

The compositions of the invention may contain linear alkylbenzene sulphonate, particularly linear alkylbenzene sulphonates having an alkyl chain length of $C_8$–$C_{15}$. It is preferred if the level of linear alkylbenzene sulphonate is from 0 wt % to 30 wt %, more preferably 1 wt % to 25 wt %, most preferably from 2 wt % to 15 wt %.

The compositions of the invention may contain other anionic surfactants in amounts additional to the percentages quoted above. Suitable anionic surfactants are well-known to those skilled in the art. Examples include primary and secondary alkyl sulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

The compositions of the invention may also contain non-ionic surfactant. Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

It is preferred if the level of non-ionic surfactant is from 0 wt % to 30 wt %, preferably from 1 wt % to 25 wt %, most preferably from 2 wt % to 15 wt %.

Any conventional fabric conditioning agent may be used in the compositions of the present invention. The conditioning agents may be cationic or non-ionic. If the fabric conditioning compound is to be employed in a main wash detergent composition the compound will typically be non-ionic. For use in the rinse phase, typically they will be cationic. They may for example be used in amounts from 0.5% to 35%, preferably from 1% to 30% more preferably from 3% to 25% by weight of the composition.

Suitable cationic fabric softening compounds are substantially water-insoluble quaternary ammonium materials comprising a single alkyl or alkenyl long chain having an average chain length greater than or equal to $C_{20}$ or, more preferably, compounds comprising a polar head group and two alkyl or alkenyl chains having an average chain length greater than or equal to $C_{14}$. Preferably the fabric softening compounds have two long chain alkyl or alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric softening compound are predominantly linear.

Quaternary ammonium compounds having two long-chain aliphatic groups, for example, distearyidimethyl ammonium chloride and di(hardened tallow alkyl) dimethyl ammonium chloride, are widely-used in commercially available rinse conditioner compositions. Other examples of these cationic compounds are to be found in "Surfactants Science Series" volume 34 ed. Richmond 1990, volume 37 ed. Rubingh 1991 and volume 53 eds. Cross and Singer 1994, Marcel Dekker Inc. New York".

Any of the conventional types of such compounds may be used in the compositions of the present invention.

The fabric softening compounds are preferably compounds that provide excellent softening, and are characterised by a chain melting Lα to Lβ transition temperature greater than 25° C., preferably greater than 35° C., most preferably greater than 45° C.

This Lα to Lβ transition can be measured by differential scanning calorimetry as defined in "Handbook of Lipid Bilayers", D Marsh, CRC Press, Boca Raton, Fla., 1990 (pages 137 and 337).

Substantially water-insoluble fabric softening compounds are defined as fabric softening compounds having a solubility of less than $1\times10^{-3}$ wt % in demineralised water at 20° C. Preferably the fabric softening compounds have a solubility of less than $1\times10^{-4}$ wt %, more preferably less than $1\times10^{-8}$ to $1\times10^{-6}$ wt %.

Especially preferred are cationic fabric softening compounds that are water-insoluble quaternary ammonium materials having two $C_{12-22}$ alkyl or alkenyl groups connected to the molecule via at least one ester link, preferably two ester links. An especially preferred ester-linked quaternary ammonium material can be represented by the formula:

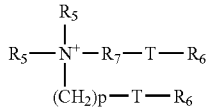

wherein each $R_5$ group is independently selected from $C_{1-4}$ alkyl or hydroxyalkyl groups or $C_{2-4}$ alkenyl groups; each $R_6$ group is independently selected from $C_{8-28}$ alkyl or alkenyl groups; and wherein $R_7$ is a linear or branched alkylene group of 1 to 5 carbon atoms, T is

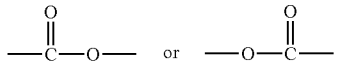

and p is 0 or is an integer from 1 to 5.

Di(tallowoxyloxyethyl) dimethyl ammonium chloride and/or its hardened tallow analogue is an especially preferred compound of this formula.

A second preferred type of quaternary ammonium material can be represented by the formula:

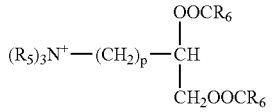

wherein $R_5$, p and $R_6$ are as defined above.

A third preferred type of quaternary ammonium material are those derived from triethanolamine (hereinafter referred to as 'TEA quats') as described in for example U.S. Pat. No. 3,915,867 and represented by formula:

$$(TOCH_2CH_2)_3N+(R_9)$$

wherein T is H or ($R_8$—CO—) where $R_8$ group is independently selected from $C_{8-28}$ alkyl or alkenyl groups and $R_9$ is $C_{1-4}$ alkyl or hydroxyalkyl groups or $C_{2-4}$ alkenyl groups. For example N-methyl-N,N,N-triethanolamine ditallowester or di-hardened-tallowester quaternary ammonium chloride or methosulphate. Examples of commercially available TEA quats include Rewoquat WE18 and Rewoquat WE20, both partially unsaturated (ex. WITCO), Tetranyl AOT-1, fully saturated (ex. KAO) and Stepantex VP 85, fully saturated (ex. Stepan).

It is advantageous if the quaternary ammonium material is biologically biodegradable.

Preferred materials of this class such as 1,2-bis(hardened tallowoyloxy)-3-trimethylammonium propane chloride and their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic fabric softeners, as described in GB 2 039 556B (Unilever).

The compositions may comprise a cationic fabric softening compound and an oil, for example as disclosed in EP-A-0829531.

The compositions may alternatively or additionally contain nonionic fabric softening agents such as lanolin and derivatives thereof.

Lecithins and other phospholipids are also suitable softening compounds.

In fabric softening compositions nonionic stabilising agent may be present. Suitable nonionic stabilising agents may be present such as linear $C_8$ to $C_{22}$ alcohols alkoxylated with 10 to 20 moles of alkylene oxide, $C_{10}$ to $C_{20}$ alcohols, or mixtures thereof. Other stabilising agents include the deflocculating polymers as described in EP 0415698A2 and EP 0458599 B1.

Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The composition can also contain fatty acids, for example $C_8$ to $C_{24}$ alkyl or alkenyl monocarboxylic acids or polymers thereof. Preferably saturated fatty acids are used, in particular, hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

It is also possible to include certain mono-alkyl cationic surfactants which can be used in main-wash compositions for fabrics. Cationic surfactants that may be used include quaternary ammonium salts of the general formula $R_1R_2R_3R_4N^+X^-$ wherein the R groups are long or short hydrocarbon chains, typically alkyl, hydroxyalkyl or ethoxylated alkyl groups, and X is a counter-ion (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

The choice of surface-active compound (surfactant), and the amount present, will depend on the intended use of the detergent composition. In fabric washing compositions, different surfactant systems may be chosen, as is well known to the skilled formulator, for handwashing products and for products intended for use in different types of washing machine.

The total amount of surfactant present will also depend on the intended end use and may be as high as 60 wt %, for example, in a composition for washing fabrics by hand. In compositions for machine washing of fabrics, an amount of from 5 to 40 wt % is generally appropriate. Typically the compositions will comprise at least 2 wt % surfactant e.g. 2–60%, preferably 15–40% most preferably 25–35%.

Detergent compositions suitable for use in most automatic fabric washing machines generally contain anionic non-soap surfactant, or non-ionic surfactant, or combinations of the two in any suitable ratio, optionally together with soap.

The compositions of the invention, when used as main wash fabric washing compositions, will generally also contain one or more detergency builders. The total amount of detergency builder in the compositions will typically range from 5 to 80 wt %, preferably from 10 to 60 wt %.

Inorganic builders that may be present include sodium carbonate, if desired in combination with a crystallisation seed for calcium carbonate, as disclosed in GB 1 437 950 (Unilever); crystalline and amorphous aluminosilicates, for example, zeolites as disclosed in GB 1 473 201 (Henkel), amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst). Inorganic phosphate builders, for example, sodium orthophosphate, pyrophosphate and tripolyphosphate are also suitable for use with this invention.

The compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50 wt %.

The alkali metal aluminosilicate may be either crystalline or amorphous or mixtures thereof, having the general formula: 0.8–1.5 $Na_2O$. $Al_2O_3$. 0.8–6 $SiO_2$ These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20.

Especially preferred is zeolite MAP having a silicon to aluminium ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di and trisuccinates, carboxymethyloxy succinates, carboxymethyloxymalonates, dipicolinates, hydroxyethyliminodiacetates, alkyl- and alkenylmalonates and succinates; and sulphonated fatty acid salts. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Compositions according to the invention may also suitably contain a bleach system. Fabric washing compositions may desirably contain peroxy bleach compounds, for example, inorganic persalts or organic peroxyacids, capable of yielding hydrogen peroxide in aqueous solution.

Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate.

Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 0.1 to 35 wt %, preferably from 0.5 to 25 wt %. The peroxy bleach compound may be used in conjunction with a bleach activator (bleach precursor) to improve bleaching action at low wash temperatures. The bleach precursor is suitably present in an amount of from 0.1 to 8 wt %, preferably from 0.5 to 5 wt %.

Preferred bleach precursors are peroxycarboxylic acid precursors, more especially peracetic acid precursors and pernoanoic acid precursors. Especially preferred bleach precursors suitable for use in the present invention are N,N,N', N',-tetracetyl ethylenediamine (TAED) and sodium nonanoyloxybenzene sulphonate (SNOBS). The novel quaternary ammonium and phosphonium bleach precursors disclosed in U.S. Pat. Nos. 4,751,015 and 4,818,426 (Lever Brothers Company) and EP 402 971A (Unilever), and the cationic bleach precursors disclosed in EP 284 292A and EP 303 520A (Kao) are also of interest.

The bleach system can be either supplemented with or replaced by a peroxyacid. examples of such peracids can be found in U.S. Pat. Nos. 4,686,063 and 5,397,501 (Unilever). A preferred example is the imido peroxycarboxylic class of peracids described in EP A 325 288, EP A 349 940, DE 382 3172 and EP 325 289. A particularly preferred example is phthalimido peroxy caproic acid (PAP). Such peracids are suitably present at 0.1–12%, preferably 0.5–10%.

A bleach stabiliser (transition metal sequestrant) may also be present. Suitable bleach stabilisers include ethylenediamine tetra-acetate (EDTA), the polyphosphonates such as Dequest (™) and non-phosphate stabilisers such as EDDS (ethylene diamine di-succinic acid). These bleach stabilisers are also useful for stain removal especially in products containing low levels of bleaching species or no bleaching species.

An especially preferred bleach system comprises a peroxy bleach compound (preferably sodium percarbonate optionally together with a bleach activator), and a transition metal bleach catalyst as described and claimed in EP 458 397A ,EP 458 398A and EP 509 787A (Unilever).

The compositions according to the invention may also contain one or more enzyme(s). Suitable enzymes include the proteases, amylases, cellulases, oxidases, peroxidases and lipases usable for incorporation in detergent compositions. Preferred proteolytic enzymes (proteases) are, catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4–12 are available and can be used in the instant invention. Examples of suitable proteolytic enzymes are the subtilisins which are obtained from particular strains of *B. Subtilis B. licheniformis*, such as the commercially available subtilisins Maxatase (™), as supplied by Genencor International N.V., Delft, Holland, and Alcalase (™), as supplied by Novozymes Industri A/S, Copenhagen, Denmark.

Particularly suitable is a protease obtained from a strain of Bacillus having maximum activity throughout the pH range of 8–12, being commercially available, e.g. from Novozymes Industri A/S under the registered trade-names Esperase (™) and Savinase (™). The preparation of these and analogous enzymes is described in GB 1 243 785. Other commercial proteases are Kazusase (Trade Mark obtainable from Showa-Denko of Japan), Optimase (™from Miles Kali-Chemie, Hannover, West Germany), and Superase (™obtainable from Pfizer of U.S.A.).

Detergency enzymes are commonly employed in granular form in amounts of from about 0.1 to about 3.0 wt %. However, any suitable physical form of enzyme may be used.

The compositions of the invention may contain alkali metal, preferably sodium carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention.

Powder flow may be improved by the incorporation of a small amount of a powder structurant, for example, a fatty acid (or fatty acid soap), a sugar, an acrylate or acrylate/maleate copolymer, or sodium silicate. One preferred powder structurant is fatty acid soap, suitably present in an amount of from 1 to 5 wt %.

Other materials that may be present in detergent compositions of the invention include sodium silicate; antiredeposition agents such as cellulosic polymers; soil release polymers; inorganic salts such as sodium sulphate; or lather boosters as appropriate; proteolytic and lipolytic enzymes; dyes; coloured speckles; perfumes; fluorescers and decoupling polymers. This list is not intended to be exhaustive. However, many of these ingredients will be better delivered as benefit agent groups in materials according to the first aspect of the invention.

The detergent composition when diluted in the wash liquor (during a typical wash cycle) will typically give a pH of the wash liquor from 7 to 10.5 for a main wash detergent.

Particulate detergent compositions are suitably prepared by spray-drying a slurry of compatible heat-insensitive ingredients, and then spraying on or post-dosing those ingredients unsuitable for processing via the slurry. The skilled detergent formulator will have no difficulty in deciding which ingredients should be included in the slurry and which should not.

Particulate detergent compositions of the invention preferably have a bulk density of at least 400 g/l, more preferably at least 500 g/l. Especially preferred compositions have bulk densities of at least 650 g/litre, more preferably at least 700 g/litre.

Such powders may be prepared either by post-tower densification of spray-dried powder, or by wholly non-tower methods such as dry mixing and granulation; in both cases a high-speed mixer/granulator may advantageously be used. Processes using high-speed mixer/granulators are disclosed, for example, in EP 340 013A, EP 367 339A, EP 390 251A and EP 420 317A (Unilever).

Liquid detergent compositions can be prepared by admixing the essential and optional ingredients thereof in any desired order to provide compositions containing components in the requisite concentrations. Liquid compositions according to the present invention can also be in compact form which means it will contain a lower level of water compared to a conventional liquid detergent.

Product Forms

Product forms include powders, liquids, gels, tablets, any of which are optionally incorporated in a water-soluble or water dispersible sachet. The means for manufacturing any of the product forms are well known in the art. If the silicone and the polymeric material are to be incorporated in a powder (optionally the powder to be tableted), and whether or not pre-emulsified, they are optionally included in a separate granular component, e.g. also containing a water soluble organic or inorganic material, or in encapsulated form.

Substrate

The substrate may be any substrate onto which it is desirable to deposit silicones and which is subjected to treatment such as a washing or rinsing process.

In particular, the substrate may be a textile fabric. It has been found that particular good results are achieved when using a natural fabric substrate such as cotton, or fabric blends containing cotton.

Treatment

The treatment of the substrate with the material of the invention can be made by any suitable method such as washing, soaking or rinsing of the substrate.

Typically the treatment will involve a washing or rinsing method such as treatment in the main wash or rinse cycle of a washing machine and involves contacting the substrate with an aqueous medium comprising the material of the invention.

EXAMPLES

General:

Synthesis of polymers were carried out under a nitrogen or argon atmosphere, and reagents were added via liquid handling robot or pipette. Size Exclusion Chromatography was performed using an automated rapid gel permeation chromatography system with polystyrene-based columns. In the current setup, N,N-dimethylformamide containing 0.1% of trifluoacetic acid was used as the eluent, and all molecular weight and polydispersity index (PDI) results obtained are relative to linear polystyrene standards. Silicone concentration in toluene extracts was quantified by a GPC method with a calibration of a series of known concentration of silicone solutions. Larger scale washing was performed in a Washtec-P machine (Roaches, UK).

Polymer Preparation:

(1) Polydimethylsiloxane-grafted Amphoteric Copolymers by Random Free Radical Polymerization These polymers were prepared by random free radical polymerization of the following monomers:

i) A silicone macromonomer (MonoMethacryloxypropyl terminated polydimethylsiloxane, supplied by Gelest Inc., Mn of 900 g/mol or 5000 g/mol, which are denoted as PDMS900-MA or PDMS5k-MA, respectively)

ii) 2-(Dimethylamino)ethyl methacrylate (denoted as MADMAE), or 2-(Dimethylamino)ethyl acrylate (denoted as DMAEA)

iii) Methacrylic acid (denoted as MM), or acrylic acid (denoted as AA), iv) Poly(ethylene glycol) methyl ether methacrylate (Mn of 475 g/mol, denoted as PEGMA), or acrylamide (denoted as AM)

General procedure: Monomers were mixed in tetrahydrofuran at 20% (wt./vol.), and AIBN as an initiator was added at 1.0 wt. % with respect to total monomers. The polymerization mixture was heated under argon at 65° C. for 15 hrs, then cooled to room temperature. Methyl iodide was added to quaternize the tertiary amino groups (2 equivalent per tertiary amino group), and the reaction mixture was allowed to stand at room temperature for 6 hrs. Polymer was isolated by evaporation of the solvent under vacuum. The reaction was carried out either in a parallel 96 reactor format with 1 mL glass vials using the combinatorial platform developed at Symyx, or in a 15 mL glass test tube.

Testing results on these random copolymers are shown on Table 1–3.

(2) Diblock and Triblock Copolymers by RAFT-polymerization

These polymers are prepared by RAFT radical polymerization of the following initial blocks with a control transfer agent (CTA) at one chain end or both chain ends and monomers:

Synthesis of Control Transfer Agent (CTA) and its attachment to hydroxy- or amino functionalized Polydimethylsiloxanes: Sold pyrazole (50 mmol) was administered to a suspension of sodium hydroxide (50 mmol) in 20 mL DMSO under nitrogen atmosphere and after 20 min stirring at room temperature (ca. 20° C.), carbon disulfide (50 mmol) was added dropwise over a period of 1 min followed by 30 min stirring. Then, the reaction was treated with 2-hydroxyethyl 2-bromo-propionate (50 mmol). The resulting reaction mixture was stirred for 12 hours and quenched with 200 mL ice/water. After 5 min stirring, the reaction was extracted with ethyl ether (3×100 mL), the combined organic phases were dried over $MgSO_4$, filtered, and concentrated (ca. 20° C./20 torr). The residue was purfied by silica-gel chromatography ($CH_2Cl_2$) to yield the hydroxy-functionalized CTA as yellow oil (60% yield, unoptimized). The hydroxy-CTA (10 mmol) was dissolved in 50 mL $CH_2Cl_2$ and added to a solution of 1,4-diisocyanate-hexane (50 mmol) in 30 mL $CH_2Cl_2$ followed by the catalytic addition of dibutyltin dilaurate (0.1 mmol). After 1 hour stirring, the solvent was stripped at room temperature under vacuum and the residue was washes with hexane (3×50 mL) to yield the control agent attached to one end of the linker, referred to as "control transfer agent-linker", as yellow oil. Coupling of the CTA-linker with the amino- or hydroxy-terminated polydimethylsiloxanes was performed by direct treatment of amino- or hydroxy-PDMS with the desired mol equivalents of CTA-linker in $CH_2CL_2$ with stirring for a minimum period of time of 30 min. For the amino-polydimethylsiloxanes the reaction was achieved without further catalysis while for the hydroxy-polydimethylsiloxanes the catalytic addition of dibutyltin dilaurate was required to obtain the coupling.

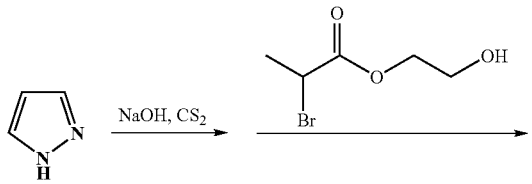

-continued

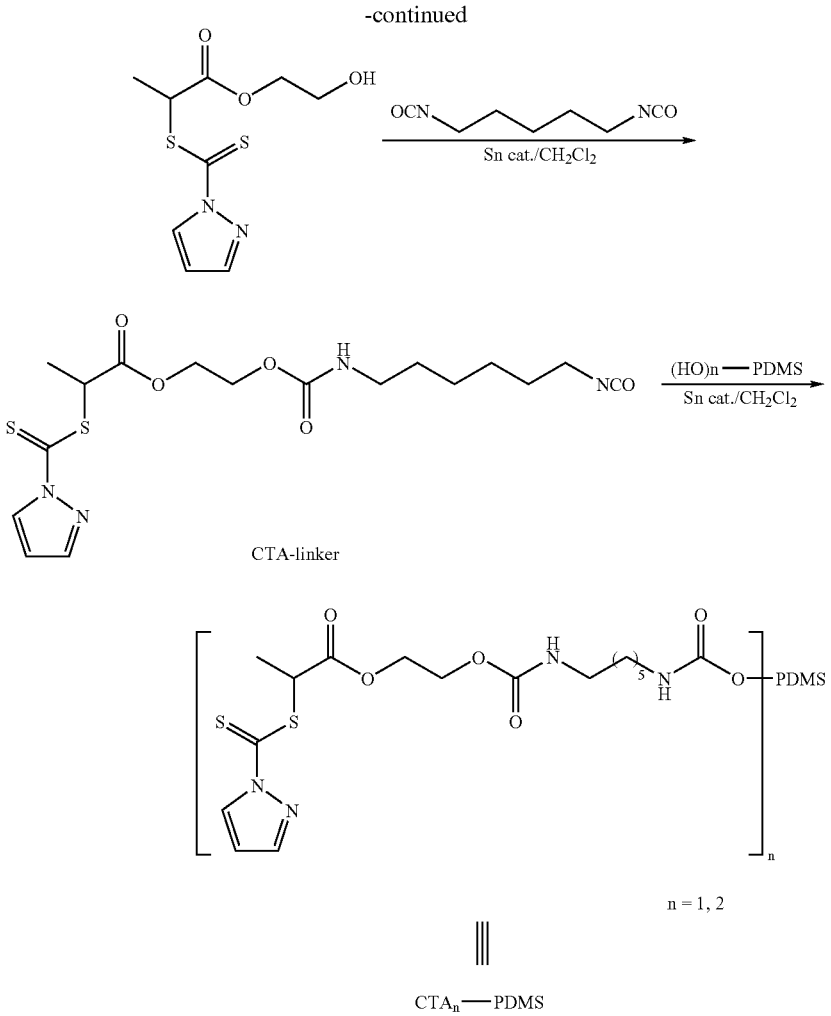

Initial blocks include (i) Hydroxyl- or amino-terminated Polydimethylsiloxanes (Mn of 1000, 3000 and 5000 g/mol) functionalized with CTA at one or both chain ends, denoted as 1K-PDMS-CTA, 3K-PDMS-CTA, 5K-PDMS-CTA for diblock precursors, and 1K-PDMS-$CTA_2$, 3K-PDMS-$CTA_2$, 5K-PDMS-$CTA_2$ for triblock precursors Monomers include (Dimethylamino)ethyl acrylate (denoted as DMAEA), acrylic acid (denoted as AA), and N-[Tris-(hydroxymethyl)methyl]acrylamide (denoted as THMMAM).

General procedure: Initial blocks and monomers were mixed in tetrahydrofuran at 20% (wt./vol.), and AIBN as an initiator was added at 1.0 wt. % with respect to total monomers. The polymerization mixture was heated under argon at 65° C. for 15 hrs, then cooled to room temperature. Methyl iodide was added to quaternize the tertiary amino groups (2 equivalent per tertiary amino group), and the reaction mixture was allowed to stand at room temperature for 12 hrs. Polymer was isolated by evaporation of the solvent under vacuum. The reaction was carried out in a parallel 96 reactor format with 1 mL glass vials using the combinatorial platform developed at Symyx.

Testing results on for these block copolymers are showed in Table 4.

Silicone Emulsion Preparation:

(1) Emulsification by Sonication 30 mg of silicone oil (Dow Corning) 3 mg of polymer and 3 mL of a non-ionic co-surfactant solution (0.02 wt. % in de-ionized water) were mixed in a 8 mL glass vial, and the mixture is then sonicated with a sonication probe to form an emulsion.

(2) Emulsification by Phase Inversion

Silicone oil (2.0 g) and co-surfactant (120 mg) were mixed in a 40-mL scintillation vial, and stirred with an Ultra-Turrax as a solution of polymer (0.2 g) in water (4.0 mL) was added slowly, followed by addition of water (10 mL). The emulsion was then transferred to a kitchen blender, and stirred for 10 min while water (184 mL) was added.

Washing Procedure and Silicone Deposition Efficiency Measurement:

(1) Small Scale Washing

In a 8 mL glass vial, silicone emulsion (0.3 mL) and model washing liquor (2.7 mL) were mixed to give a silicone concentration of 1000 mg/L, and two piece of cotton fabric (150 mg each) were added. The glass vial was gently shaken at ambient temperature for 1 hour. The cotton samples were then rinsed with de-ionized water and dried.

The silicone adsorbed on the fabric was extracted by toluene and quantified by GPC. The deposition efficiency (DE) was calculated as the ratio of the extracted to the initial silicone in %.

(2) Model Washing

In a 550 mL steel washpot, silicone emulsion and model washing liquor were mixed to give a silicone concentration of 250 mg/L, and one piece of cotton fabric (fabric/wash ratio=1/8) was added. The washpot was sealed and placed in a Washtec-p machine, and the washing was conducted at 40° C. for 45 min. The cotton samples were then rinsed with de-ionized water and dried. The silicone adsorbed on the fabric was extracted by toluene and quantified by GPC. The deposition efficiency (DE) was calculated as the ratio of the extracted to the initial silicone in %.

Model Wash Formulation:

| | |
|---|---|
| Anionic surfactant (LAS) | 0.55 g/L |
| Non-ionic surfactant R(EO)7 | 0.45 g/L |
| Trisodium citrate | 0.175 g/L |
| Sodium carbonate | 0.29 g/L |
| Sodium bicarbonate | 0.05 g/L |
| Sodium sulphate | 1.10 g/L |

Results

Polymers 1–131 are silicone emulsions prepared with silicone oil of viscosity 350cSt by sonication, and small scale washing procedure was used for washing. Under small scale washing conditions, the blank experiments (silicone emulsion without polymers) give deposition efficiency of less than 14%. In examples 132–143, all silicone emulsions were prepared with silicone oil of viscosity 350 cSt by sonication, and in selected examples (133, 136, 137 and 140), emulsions were also prepared by phase inversion. The large scale washing procedure was used for washing, and under these conditions, the control experiments give deposition efficiency of 19% (when emulsion prepared by sonication) and 16% (when emulsion prepared by phase inversion). In examples 144–149, silicone emulsions were prepared with silicone oil of viscosity 100cSt by sonication, and primary screening procedure was used for washing. Under these conditions, the blank experiments give deposition efficiency of 5%. From these results, it becomes clear that these random or block copolymers increase the silicone deposition on cotton fabric, when compared to the blank experiments.

TABLE 1

| | Monomer compositions in feed (mg) | | | | | | | |
|---|---|---|---|---|---|---|---|---|
| Example | PDMS900-MA | PDMS5k-MA | MADMAE | MAA | PEGMA | Mw ($\times 10^3$) | PDI | DE (%) |
| 1 | 5.0 | 0 | 41.4 | 0 | 53.6 | 429 | 1.37 | 36 |
| 2 | 5.0 | 0 | 47.3 | 0 | 47.7 | 466 | 1.32 | 40 |
| 3 | 5.0 | 0 | 54.1 | 0 | 40.9 | 464 | 1.33 | 40 |
| 4 | 5.0 | 0 | 62.0 | 0 | 33.0 | 475 | 1.33 | 42 |
| 5 | 10.0 | 0 | 39.2 | 0 | 50.8 | 442 | 1.36 | 39 |
| 6 | 10.0 | 0 | 44.8 | 0 | 45.2 | 449 | 1.35 | 37 |
| 7 | 10.0 | 0 | 51.3 | 0 | 38.7 | 462 | 1.37 | 28 |
| 8 | 10.0 | 0 | 58.7 | 0 | 31.3 | 474 | 1.34 | 21 |
| 9 | 15.0 | 0 | 37.0 | 0 | 48.0 | 439 | 1.35 | 15 |
| 10 | 15.0 | 0 | 42.4 | 0 | 42.6 | 448 | 1.35 | 37 |
| 11 | 15.0 | 0 | 48.4 | 0 | 36.6 | 450 | 1.35 | 31 |
| 12 | 15.0 | 0 | 55.4 | 0 | 29.6 | 486 | 1.35 | 31 |
| 13 | 0 | 5.0 | 41.4 | 0 | 53.6 | 456 | 1.37 | 31 |
| 14 | 0 | 5.0 | 47.3 | 0 | 47.7 | 458 | 1.36 | 44 |
| 15 | 0 | 5.0 | 54.1 | 0 | 40.9 | 475 | 1.35 | 35 |
| 16 | 0 | 5.0 | 62.0 | 0 | 33.0 | 479 | 1.35 | 40 |
| 17 | 0 | 10.0 | 39.2 | 0 | 50.8 | 430 | 1.38 | 34 |
| 18 | 0 | 10.0 | 44.8 | 0 | 45.2 | 437 | 1.32 | 48 |
| 19 | 0 | 10.0 | 51.3 | 0 | 38.7 | 439 | 1.34 | 41 |
| 20 | 0 | 10.0 | 58.7 | 0 | 31.3 | 451 | 1.32 | 37 |
| 21 | 0 | 15.0 | 37.0 | 0 | 48.0 | 422 | 1.34 | 27 |
| 22 | 0 | 15.0 | 42.4 | 0 | 42.6 | 448 | 1.33 | 35 |
| 23 | 0 | 15.0 | 48.4 | 0 | 36.6 | 437 | 1.31 | 50 |
| 24 | 0 | 15.0 | 55.4 | 0 | 29.6 | 438 | 1.32 | 34 |
| 25 | 5.0 | 0 | 48.9 | 3.8 | 42.2 | 507 | 1.34 | 42 |
| 26 | 5.0 | 0 | 54.8 | 3.3 | 36.8 | 519 | 1.31 | 41 |
| 27 | 5.0 | 0 | 61.3 | 2.8 | 30.9 | 530 | 1.31 | 46 |
| 28 | 5.0 | 0 | 68.5 | 2.2 | 24.3 | 509 | 1.35 | 37 |
| 29 | 10.0 | 0 | 46.4 | 3.6 | 40.0 | 497 | 1.33 | 32 |
| 30 | 10.0 | 0 | 52.0 | 3.2 | 34.9 | 502 | 1.30 | 41 |
| 31 | 10.0 | 0 | 58.1 | 2.7 | 29.3 | 495 | 1.32 | 39 |
| 32 | 10.0 | 0 | 64.9 | 2.1 | 23.1 | 525 | 1.30 | 38 |
| 33 | 15.0 | 0 | 43.8 | 3.4 | 37.8 | 497 | 1.30 | 31 |
| 34 | 15.0 | 0 | 49.1 | 3.0 | 32.9 | 483 | 1.28 | 30 |
| 35 | 15.0 | 0 | 54.9 | 2.5 | 27.6 | 484 | 1.32 | 26 |
| 36 | 15.0 | 0 | 61.3 | 2.0 | 21.8 | 499 | 1.36 | 34 |
| 37 | 0 | 5.0 | 48.9 | 3.8 | 42.2 | 472 | 1.35 | 47 |
| 38 | 0 | 5.0 | 54.8 | 3.3 | 36.8 | 487 | 1.33 | 44 |
| 39 | 0 | 5.0 | 61.3 | 2.8 | 30.9 | 478 | 1.34 | 52 |
| 40 | 0 | 5.0 | 68.5 | 2.2 | 24.3 | 490 | 1.31 | 49 |
| 41 | 0 | 10.0 | 46.4 | 3.6 | 40.0 | 469 | 1.34 | 46 |

TABLE 1-continued

| Example | Monomer compositions in feed (mg) | | | | | Mw ($\times 10^3$) | PDI | DE (%) |
|---|---|---|---|---|---|---|---|---|
| | PDMS900-MA | PDMS5k-MA | MADMAE | MAA | PEGMA | | | |
| 42 | 0 | 10.0 | 52.0 | 3.2 | 34.9 | 504 | 1.34 | 43 |
| 43 | 0 | 10.0 | 58.1 | 2.7 | 29.3 | 455 | 1.34 | 34 |
| 44 | 0 | 10.0 | 64.9 | 2.1 | 23.1 | 464 | 1.33 | 44 |
| 45 | 0 | 15.0 | 43.8 | 3.4 | 37.8 | 457 | 1.33 | 49 |
| 46 | 0 | 15.0 | 49.1 | 3.0 | 32.9 | 459 | 1.33 | 51 |
| 47 | 0 | 15.0 | 54.9 | 2.5 | 27.6 | 447 | 1.32 | 49 |
| 48 | 0 | 15.0 | 61.3 | 2.0 | 21.8 | 443 | 1.34 | 48 |
| 49 | 5.0 | 0 | 59.8 | 9.4 | 25.8 | 530 | 1.38 | 40 |
| 50 | 5.0 | 0 | 65.2 | 7.9 | 21.9 | 523 | 1.38 | 49 |
| 51 | 5.0 | 0 | 70.7 | 6.5 | 17.8 | 508 | 1.37 | 50 |
| 52 | 5.0 | 0 | 76.5 | 4.9 | 13.6 | 741 | 1.29 | 47 |
| 53 | 10.0 | 0 | 56.7 | 8.9 | 24.5 | 538 | 1.36 | 43 |
| 54 | 10.0 | 0 | 61.8 | 7.5 | 20.7 | 524 | 1.36 | 30 |
| 55 | 10.0 | 0 | 67.0 | 6.1 | 16.9 | 508 | 1.37 | 21 |
| 56 | 10.0 | 0 | 72.5 | 4.7 | 12.9 | 496 | 1.36 | 30 |
| 57 | 15.0 | 0 | 53.5 | 8.4 | 23.1 | 509 | 1.38 | 32 |
| 58 | 15.0 | 0 | 58.3 | 7.1 | 19.6 | 515 | 1.35 | 12 |
| 59 | 15.0 | 0 | 63.3 | 5.8 | 15.9 | 516 | 1.34 | 20 |
| 60 | 15.0 | 0 | 68.4 | 4.4 | 12.2 | 487 | 1.35 | 18 |
| 61 | 0 | 5.0 | 59.8 | 9.4 | 25.8 | 570 | 1.34 | 14 |
| 62 | 0 | 5.0 | 65.2 | 7.9 | 21.9 | 1118 | 1.39 | 17 |
| 63 | 0 | 5.0 | 70.7 | 6.5 | 17.8 | 582 | 1.34 | 38 |
| 64 | 0 | 5.0 | 76.5 | 4.9 | 13.6 | 576 | 1.32 | 41 |
| 65 | 0 | 10.0 | 56.7 | 8.9 | 24.5 | 567 | 1.36 | 26 |
| 66 | 0 | 10.0 | 61.8 | 7.5 | 20.7 | 556 | 1.33 | 40 |
| 67 | 0 | 10.0 | 67.0 | 6.1 | 16.9 | 561 | 1.32 | 47 |
| 68 | 0 | 10.0 | 72.5 | 4.7 | 12.9 | 568 | 1.32 | 43 |
| 69 | 0 | 15.0 | 53.5 | 8.4 | 23.1 | 567 | 1.33 | 46 |
| 70 | 0 | 15.0 | 58.3 | 7.1 | 19.6 | 560 | 1.32 | 42 |
| 71 | 0 | 15.0 | 63.3 | 5.8 | 15.9 | 542 | 1.33 | 44 |
| 72 | 0 | 15.0 | 68.4 | 4.4 | 12.2 | 552 | 1.31 | 30 |
| 73 | 5.0 | 0 | 76.9 | 18.1 | 0 | 638 | 1.38 | 26 |
| 74 | 5.0 | 0 | 80.3 | 14.7 | 0 | 646 | 1.36 | 28 |
| 75 | 5.0 | 0 | 83.6 | 11.4 | 0 | 642 | 1.39 | 22 |
| 76 | 5.0 | 0 | 86.6 | 8.4 | 0 | 605 | 1.34 | 27 |
| 77 | 10.0 | 0 | 72.9 | 17.1 | 0 | 651 | 1.36 | 27 |
| 78 | 10.0 | 0 | 76.1 | 13.9 | 0 | 627 | 1.38 | 23 |
| 79 | 10.0 | 0 | 79.2 | 10.8 | 0 | 609 | 1.38 | 21 |
| 80 | 10.0 | 0 | 82.1 | 7.9 | 0 | 596 | 1.35 | 22 |
| 81 | 15.0 | 0 | 68.8 | 16.2 | 0 | 743 | 1.39 | 28 |
| 82 | 15.0 | 0 | 71.9 | 13.1 | 0 | 600 | 1.38 | 27 |
| 83 | 15.0 | 0 | 74.8 | 10.2 | 0 | 586 | 1.37 | 24 |
| 84 | 15.0 | 0 | 77.5 | 7.5 | 0 | 589 | 1.36 | 20 |
| 85 | 0 | 5.0 | 76.9 | 18.1 | 0 | 647 | 1.35 | 49 |
| 86 | 0 | 5.0 | 80.3 | 14.7 | 0 | 623 | 1.37 | 53 |
| 87 | 0 | 5.0 | 83.6 | 11.4 | 0 | 596 | 1.36 | 52 |
| 88 | 0 | 5.0 | 86.6 | 8.4 | 0 | 594 | 1.33 | 49 |
| 89 | 0 | 10.0 | 72.9 | 17.1 | 0 | 623 | 1.39 | 26 |
| 90 | 0 | 10.0 | 76.1 | 13.9 | 0 | 600 | 1.37 | 48 |
| 91 | 0 | 10.0 | 79.2 | 10.8 | 0 | 561 | 1.37 | 36 |
| 92 | 0 | 10.0 | 82.1 | 7.9 | 0 | 560 | 1.35 | 47 |
| 93 | 0 | 15.0 | 68.8 | 16.2 | 0 | 739 | 1.42 | 43 |
| 94 | 0 | 15.0 | 71.9 | 13.1 | 0 | 600 | 1.34 | 57 |
| 95 | 0 | 15.0 | 74.8 | 10.2 | 0 | 578 | 1.34 | 55 |
| 96 | 0 | 15.0 | 77.5 | 7.5 | 0 | 545 | 1.33 | 39 |

TABLE 2

| Example | Monomer compositions in feed (mg) | | | | Mw ($\times 10^3$) | PDI | DE (%) |
|---|---|---|---|---|---|---|---|
| | PDMS900-MA | DMAEA | AA | AM | | | |
| 97 | 20.0 | 60.1 | 0.0 | 19.9 | 240 | 1.32 | 44 |
| 98 | 20.0 | 68.6 | 0.0 | 11.4 | 215 | 1.29 | 41 |
| 99 | 20.0 | 75.8 | 0.0 | 4.2 | 183 | 1.27 | 39 |
| 100 | 30.0 | 52.6 | 0.0 | 17.4 | 240 | 1.31 | 45 |

TABLE 2-continued

| Example | Monomer compositions in feed (mg) | | | | Mw ($\times 10^3$) | PDI | DE (%) |
|---|---|---|---|---|---|---|---|
| | PDMS900-MA | DMAEA | AA | AM | | | |
| 101 | 30.0 | 60.1 | 0.0 | 9.9 | 214 | 1.28 | 44 |
| 102 | 30.0 | 66.3 | 0.0 | 3.7 | 186 | 1.26 | 43 |
| 103 | 20.0 | 60.1 | 4.0 | 15.9 | 235 | 1.36 | 40 |
| 104 | 20.0 | 68.6 | 2.3 | 9.1 | 207 | 1.31 | 42 |

TABLE 2-continued

| Example | Monomer compositions in feed (mg) PDMS900-MA | DMAEA | AA | AM | Mw ($\times 10^3$) | PDI | DE (%) |
|---|---|---|---|---|---|---|---|
| 105 | 20.0 | 75.8 | 0.8 | 3.3 | 182 | 1.28 | 42 |
| 106 | 30.0 | 52.6 | 3.5 | 13.9 | 239 | 1.34 | 43 |
| 107 | 30.0 | 60.0 | 2.0 | 7.9 | 210 | 1.30 | 50 |
| 108 | 30.0 | 66.3 | 0.7 | 2.9 | 179 | 1.27 | 49 |
| 109 | 20.0 | 60.0 | 8.1 | 11.9 | 270 | 1.37 | 36 |
| 110 | 20.0 | 68.6 | 4.6 | 6.8 | 221 | 1.30 | 42 |
| 111 | 20.0 | 75.8 | 1.7 | 2.5 | 193 | 1.27 | 44 |
| 112 | 30.0 | 52.5 | 7.0 | 10.4 | 262 | 1.36 | 36 |
| 113 | 30.0 | 60.0 | 4.0 | 6.0 | 219 | 1.29 | 43 |
| 114 | 30.0 | 66.3 | 1.5 | 2.2 | 188 | 1.26 | 49 |
| 115 | 20.0 | 60.0 | 12.1 | 7.9 | 264 | 1.42 | 23 |
| 116 | 20.0 | 68.6 | 6.9 | 4.5 | 226 | 1.33 | 44 |
| 117 | 20.0 | 75.8 | 2.5 | 1.7 | 185 | 1.29 | 44 |
| 118 | 30.0 | 52.5 | 10.6 | 6.9 | 238 | 1.37 | 23 |
| 119 | 30.0 | 60.0 | 6.0 | 4.0 | 214 | 1.32 | 40 |
| 120 | 30.0 | 66.3 | 2.2 | 1.5 | 184 | 1.28 | 44 |
| 121 | 20.0 | 68.5 | 9.2 | 2.3 | 224 | 1.34 | 38 |
| 122 | 20.0 | 75.8 | 3.4 | 0.8 | 181 | 1.29 | 42 |
| 123 | 30.0 | 52.5 | 14.1 | 3.5 | 198 | 1.28 | 20 |
| 124 | 30.0 | 60.0 | 8.0 | 2.0 | 224 | 1.32 | 35 |
| 125 | 30.0 | 66.3 | 3.0 | 0.7 | 189 | 1.28 | 29 |
| 126 | 20.0 | 59.9 | 20.1 | 0.0 | 187 | 1.24 | 12 |
| 127 | 20.0 | 68.5 | 11.5 | 0.0 | 228 | 1.36 | 34 |
| 128 | 20.0 | 75.8 | 4.2 | 0.0 | 180 | 1.29 | 43 |
| 129 | 30.0 | 52.4 | 17.6 | 0.0 | 174 | 1.23 | 17 |
| 130 | 30.0 | 59.9 | 10.1 | 0.0 | 166 | 1.33 | 36 |
| 131 | 30.0 | 66.3 | 3.7 | 0.0 | 188 | 1.27 | 38 |

Formulation Examples 1–5

Raw material specification:

| Component | Specification |
|---|---|
| LAS | Alkyl Benzene Sulphonic-acid, Marlon AS3, ex Huls |
| LES | Linear ether sulfate |
| A7 | Synperonic A7 (C13–15 EO7) |
| TAED | Tetraacetate ethylene diamine |
| Tween 20 | Polyoxyethylenesorbitan (POE) 20 sorbitan monolaurate (Polyethylene glycol sorbitan monolaurate) |
| EDTMP | Ethylene diaminetetramethylene phosphonate |
| CMC | Carboxymethyl cellulose |
| Nabion 15 | Carbonate/disilicate co-granule |
| PVP | Dye transfer inhibitor |
| EDHP | Sequestering agent |
| Na-PAS | Primary Alkyl Benzene Sulphonic-acid, neutralised with NaOH |
| Dobanol 25-7 | $C_{12-15}$ ethoxylated alcohol, 7EO, ex shell |
| Zeolite | Wassalith P, ex Degussa |
| STPP | Sodium Tri Polyphosphate, Thermphos NW, ex Hoechst |
| Dequest 2066 | Metal chelating agent, ex Monsanto |
| Lipolase | Type 100L, ex Novo |
| Savinase 16L | Protease, ex Novo |
| Sokalan CP5 | Acrylic/Maleic Builder Polymer, ex BASF |
| Defloculating Polymer | Polymer A-11 disclosed in EP-A-346 995 |
| SCMC | Sodium Carboxymethyl Cellulose |

TABLE 3

| Example | Monomer compositions in feed (mg) PDMS900-MA | PDMS5k-MA | MADMAE | MAA | PEGMA | Mw ($\times 10^3$) | PDI | DE (%)[a] | DE (%)[b] |
|---|---|---|---|---|---|---|---|---|---|
| 132 | 0 | 90 | 291 | 0 | 219 | 551 | 1.40 | 36 | n/a |
| 133 | 0 | 30 | 368 | 17 | 185 | 582 | 1.42 | 48 | 52 |
| 134 | 0 | 90 | 294 | 18 | 198 | 598 | 1.39 | 37 | n/a |
| 135 | 0 | 90 | 329 | 15 | 166 | 564 | 1.39 | 35 | n/a |
| 136 | 30 | 0 | 424 | 39 | 107 | 603 | 1.42 | 51 | 57 |
| 137 | 0 | 30 | 482 | 88 | 0 | 731 | 1.40 | 44 | 61 |
| 138 | 0 | 30 | 510 | 69 | 0 | 705 | 1.39 | 34 | n/a |
| 139 | 0 | 90 | 431 | 79 | 0 | 764 | 1.39 | 40 | n/a |
| 140 | 0 | 90 | 449 | 61 | 0 | 695 | 1.39 | 50 | 65 |
| 141 | 0 | 120 | 277 | 17 | 186 | 584 | 1.41 | 31 | n/a |
| 142 | 0 | 180 | 288 | 35 | 97 | 588 | 1.53 | 37 | n/a |
| 143 | 180 | 0 | 355 | 65 | 0 | 651 | 1.42 | 29 | n/a |

[a]emulsion prepared by sonication;
[b]emulsion prepared by phase inversion.

TABLE 4

| Example | Block-Type | Block and Monomer compositions in feed (mg) Initial Block | DMAEA | AA | THMMAM | Mw ($\times 10^3$) | PDI | DE (%)[a] |
|---|---|---|---|---|---|---|---|---|
| 144 | 5K-PDMS-CTA | 13.4 | 25.9 | 2.0 | 8.7 | n/a | n/a | 11 |
| 145 | 5K-PDMS-CTA | 12.8 | 15.4 | 1.2 | 20.6 | n/a | n/a | 6 |
| 146 | 5K-PDMS-$CTA_2$ | 12.7 | 15.4 | 1.2 | 20.6 | 72 | 1.09 | 9.5 |
| 147 | 5K-PDMS-$CTA_2$ | 13.4 | 11.3 | 3.6 | 21.7 | 91 | 1.13 | 8 |
| 148 | 5K-PDMS-$CTA_2$ | 14.0 | 7.8 | 5.6 | 22.6 | 114 | 1.17 | 9 |
| 149 | 5K-PDMS-$CTA_2$ | 14.4 | 5.6 | 6.8 | 23.1 | 146 | 1.22 | 5 |

[a]emulsion prepared by sonication with 100 cSt silicone oil, and blank has DE 5%.

-continued

| Raw material specification: | |
|---|---|
| Component | Specification |
| Minors | Antiredeposition polymers, transition-metal scavangers/bleach stabilisers, fluorescers, dye-transfer-inhibition polymers, enzymes |
| Polymer 1 | As defined above. |

Example 1

Tablet Formulation

| | Phosphate (%) | Acetate (%) |
|---|---|---|
| Anionic Surfactant (LAS) | 7.5 | 8.5 |
| Nonionic Surfactant (7EO) | 3.5 | 4 |
| Soap | 0.6 | 0.6 |
| Zeolite MAP | 15.5 | 19 |
| Na-acetate | 2.5 | 25 |
| Sodium tripolyphosphate (High Phase A) | 32 | |
| Na-disilicate | 2.5 | 2.5 |
| Phosphonates | 0.6 | 1 |
| Sodium carbonate | 2.8 | 3 |
| TAED | 3 | 4 |
| Sodium percarbonate | 11 | 14 |
| Enzymes | 1 | 1 |
| Minors (eg Fluorescer, Antifoam adjuncts, moisture) | 6.5 | 6.5 |
| Granule* | 11 | 11 |
| | 100 | 100.1 |

*A granule of emulsion of Polymer 1, silicone and nonionic surfactant (2% total in $H_2O$) granulated with carrier.

Example 2

Standard Powder Formulation

| Ingredient | Level (%) |
|---|---|
| Na-LAS | 8.75 |
| NI 7EO | 6.83 |
| Soap | 1.44 |
| Zeolite | 19.78 |
| Copolymer CP5 | 0.76 |
| Na silicate | 0.73 |
| Na carbonate | 11.81 |
| Na sulfate | 7.06 |
| CMC | 0.29 |
| Moisture&Salts | 5.0 |
| TAED 83% | 2.50 |
| Na percarbonate | 12.25 |
| Fluoresecer | 0.8 |
| EDTMP | 0.65 |
| EHDP | 0.45 |
| Carbonate/Disilicate | 3.35 |
| Citric acid | 2.55 |
| Enzyme | 0.5 |
| Minors | 2.50 |
| Granule as example 1 | 12.00 |

Example 3

Concentrate Powder Formulation

| Ingredient | Level (%) |
|---|---|
| LAS acid | 8.30 |
| Sodium hydroxide | 0.50 |

-continued

| Ingredient | Level (%) |
|---|---|
| NI 7EO | 7.0 |
| Zeolite | 19.90 |
| Na carbonate | 8.90 |
| CMC | 0.35 |
| Moisture & Salts | 4.0 |
| TAED 83% | 5.0 |
| Na percarbonate | 20.00 |
| Fluorescer | 1.30 |
| Nabion 15 | 5.50 |
| EDTMP | 0.90 |
| EHDP | 0.50 |
| Carbonate | 2.50 |
| Sodium citrate | 2.00 |
| Enzyme | 0.90 |
| Minors | 0.45 |
| Granule as example 1 | 12.0 |

Example 4

Concentrate Liquid Formuation

| Ingredient | Level (%) | Level (%) |
|---|---|---|
| Nonionic 7 EO | 21.00 | 8.00 |
| LES | | 8.00 |
| LAS | | 8.00 |
| Fatty acid | 12.87 | 8.00 |
| Citric Acid | 1.00 | |
| Antiredeposition polymer | 0.41 | 0.41 |
| Sodium Hydroxide - 50% | | 3.10 |
| Potassium hydroxide | 3.88 | |
| Preservative | 0.01 | 0.01 |
| Propylene Glycol | 9.00 | 4.00 |
| NaCl | | 1.00 |
| Boric Acid | 1.00 | 1.00 |
| Fluoroscer | 0.05 | 0.05 |
| Base liquid | 49.22 | 41.57 |
| Water & salts | 37.44 | 45.09 |
| | 86.66 | 86.66 |
| PVP (30%) | 0.30 | 0.30 |
| Silicone antifoam | | |
| Enzyme | 0.50 | 0.50 |
| EHDP | 1.00 | 1.00 |
| Minors(average) | 0.54 | 0.54 |
| Granule as example 1 | 11.00 | 11.00 |
| Total | 100.0 | 100.0 |

Example 5

Dilute Liquid Formulation

| Ingredient | Example A Inclusion level (%) | Example B Inclusion level (%) |
|---|---|---|
| Nonionic 7 EO | 11.36 | 4.50 |
| LES | | 4.50 |
| LAS | | 4.50 |
| Fatty acid | 6.69 | 4.50 |
| Citric Acid | 1.50 | |
| Antiredeposition polymer | 0.23 | 0.25 |
| Sodium Hydroxide - 50% | | 1.91 |
| Potassium hydroxide | 3.06 | |
| Preservative | 0.02 | 0.02 |
| Propylene Glycol | 6.00 | 4.00 |
| NaCl | | 1.50 |
| Boric Acid | 1.00 | 1.00 |
| Fluorescer | 0.02 | 0.02 |
| base liquid | 29.88 | 26.70 |
| Water & salts | 57.87 | 61.05 |

-continued

| Ingredient | Example A Inclusion level (%) | Example B Inclusion level (%) |
|---|---|---|
| | 87.75 | 87.75 |
| PVP (30%) | 0.05 | 0.05 |
| Silicone antifoam | | |
| Enzyme | 0.30 | 0.30 |
| EHDP | 0.50 | 0.50 |
| Minors | 0.40 | 0.40 |
| Granule as example 1 | 11.00 | 11.00 |
| Total | 100.00 | 100.00 |

Example 6

Soluble Sachet Formulation

A soluble sachet containing the following detergent powder was prepared. The sachet was made in the form of a rectangular package of water-soluble film produced by thermoforming a recess followed by filling and water-sealing the top with a second film. A first sheet of polyvinyl alcohol film (85 micrometer thickness) was used to form the recess.

A detergent powder was made of the following composition by pregranulating the base powder ingredients, followed by post-dosing the rest of the ingredients

| Ingredient | Level (%) |
|---|---|
| Na-LAS | 8.75 |
| NI 7EO | 6.83 |
| Soap | 1.44 |
| Zeolite | 19.78 |
| Copolymer CP5 | 0.76 |
| Na silicate | 0.73 |
| Na carbonate | 11.81 |
| Na sulfate | 7.06 |
| CMC | 0.29 |
| Moisture & Salts | 5.0 |
| TAED 83% | 2.50 |
| Na percarbonate | 12.25 |
| Fluoresecer | 0.8 |
| EDTMP | 0.65 |
| EHDP | 0.45 |
| Carbonate/Disilicate | 3.35 |
| Citric acid | 2.55 |
| Enzyme | 0.5 |
| Minors | 2.50 |
| Granule as example 1 | 12.0 |

This detergent powder was dosed in the recess of the soluble sachet. After the powder was added, a second sheet of polyvinylalcohol (45 micron thickness) was added on top of the compartment and sealed to the first sheet along a continuous region to form a closed water soluble sachet containing the detergent powder.

Example 7

Soluble Sachet Formulation

| Raw Material | % |
|---|---|
| Nonionic | 24.00 |
| Pigment Premix/dye | 0.020 |
| Monopropylene glycol | 4.95 |
| Glycerol | 19.5 |
| Monoethanolamine | 6.9 |
| Fatty Acid (oleic) | 11.90 |
| Softened water | 2.28 |
| LAS Acid | 18.10 |
| Minors | 1.45 |

-continued

| Raw Material | % |
|---|---|
| Enzymes | 0.9 |
| Granule as example 1 | 10.00 |
| Total | 100 |

The invention claimed is:

1. A laundry treatment composition comprising at least one polymeric material comprising a cationic polymer moiety and a polydialkylsiloxane moiety, and at least one other component, wherein the polymeric material is incorporated in the form of an emulsion with a silicone and wherein the polymeric material has a formula selected from:

$(A\text{-}b\text{-}B)_n\text{-}A$ $(A\text{-}b\text{-}B)_n$ $A\text{-}g\text{-}(B)_n$ $(A\text{-}r\text{-}B)_n$ $(B\text{-}b\text{-}A)_n\text{-}B$ $(B\text{-}b\text{-}A)_n$ $B\text{-}g\text{-}(A)_n$ wherein:

A is a moiety that contains one or more cationic monomer units, preferably comprising from 5% to 100% by weight of cationic monomer units, the balance of A comprising from 0% to 95%, by weight of anionic monomer units and/or from 0% to 95%, by weight of neutral monomer units, wherein the weight fraction of A is from 5% to 95%, any balance being independently selected from one or more of anionic monomer units and/or cationic monomer units in block and/or random fashion, and wherein at least some of the cationic moieties A are selected from those derived from monomers of formula (I):

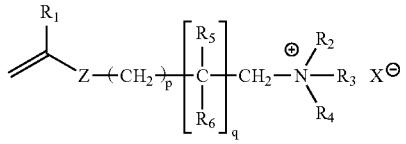

(I)

wherein $R_1$ is H or $CH_3$ $R_2$, $R_3$, $R_4$ are independently selected from linear or branched $C_1$–$C_6$ alkyl groups;

$R_5$, $R_6$ are independently H or $CH_3$;

P is from 0 to 3;

q is 0 or 1;

z is —(CO)O—, —C(O)NH—, or —O—; and $X^-$ is an appropriate counter ion,

B is siloxane-containing moiety;

n is from 1 to 50;

-b- indicates that A and B are connected via the termini of A and B respectively; and -g- indicates that either A or B segment is attached anywhere pendant on the B or A block respectively;

-r- indicates that A and B are polymerised to form a random copolymer; and wherein at least some of the cationic moieties A are selected from those derived from monomers (II)

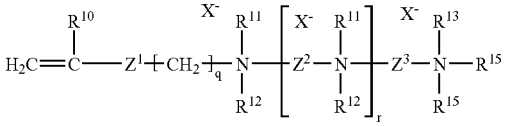

of formula (II):

in which:

each $R^{10}$, $R^{11}$, $R^{12}$, $R^{13}$ and $R^{14}$ is independently selected from alkyl, hydroxylalkyl or aminoalkyl groups in which the alkyl moiety is a linear or branched $C_1$–$C_6$ chain;

$R^{15}$ is hydrogen, methyl or ethyl;

q is from 0 to 10, r is from 1 to 6;

$Z^1$ is as defined for Z in formula (I);

$Z^2$ represents a $(CH_2)_s$ group, s being from 1 to 6;

$Z^3$ is a linear or branched $C_2$–$C_{12}$, polymethylene chain optionally interrupted by one or more heteroatoms or heterogroups, and optionally substituted by one or more hydroxyl or amino groups; and each $X^-$, is independently as defined in formula (I); and and also from ethylenically unsaturated monomers containing an aliphatic or aromatic cyclic moiety which contains a charged nitrogen ($N^+$) atom.

2. The composition of claim 1, wherein B is a polydialkylsiloxane of formula

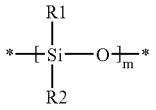

where R1 and R2 and indifferently H, alkyl or aryl groups, and m is an integer from 2 to 200, graft branched and hyperbranched polysiloxane analogues also being included, R1 or R2 optionally carrying cationic groups; and A is a polymer of formula

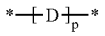

wherein each D is an independently selected monomer unit and p an integer comprised of from 5 to 500,000, and A having between 5 mol. % to 100 mol. % of cationic monomers.

3. The laundry treatment composition of claim 1, comprising from 0.01% to 25% by weight of the polymeric material.

4. The laundry treatment composition of claim 1, wherein the at least one further ingredient comprises a surfactant.

5. The laundry treatment composition of claim 2, wherein the surfactant comprises an anionic surfactant.

6. The laundry treatment composition of claim 1, wherein the emulsion further comprises an emulsifying agent.

7. The laundry treatment composition of claim 4, wherein the emulsifying agent comprises a non ionic surfactant.

8. The laundry treatment composition of claim 1, wherein the total amount of silicone is from 50 to 95% by weight of the silicone and any emulsifying agent.

9. The laundry treatment composition of claim 1, wherein the emulsion is 30 to 99.9% of another liquid component.

10. The laundry treatment composition of claim 4, wherein the weight ratio of silicone to emulsifying agent is from 100:1 to 2:1.

11. A method of depositing a polymer onto a substrate, the method comprising contacting in an aqueous solution, the substrate and a laundry treatment composition comprising at least one polymeric material comprising a cationic polymer moiety and a polydialkylsiloxane moiety, and at least one other component; wherein the polymeric material is incorporated in the form of an emulsion with a silicone and wherein the polymeric material has a formula selected from:

$(A\text{-}b\text{-}B)_n\text{-}A$ $(A\text{-}b\text{-}B)_n$ $A\text{-}g\text{-}(B)_n$ $(A\text{-}r\text{-}B)_n$ $(B\text{-}b\text{-}A)_n\text{-}B$ $(B\text{-}b\text{-}A)_n$ $B\text{-}g\text{-}(A)_n$ wherein:

A is a moiety that contains one or more cationic monomer units, preferably comprising from 5% to 100% by weight of cationic monomer units, the balance of A comprising from 0% to 95%, by weight of anionic monomer units and/or from 0% to 95%, by weight of neutral monomer units, wherein the weight fraction of A is from 5% to 95%, any balance being independently selected from one or more of anionic monomer units and/or cationic monomer units in block and/or random fashion, and wherein at least some of the cationic moieties A are selected from those derived from monomers of formula (I):

(I)

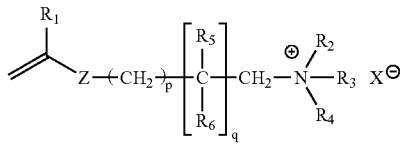

wherein $R_1$ is H or $CH_3$ $R_2$, $R_3$, $R_4$ are independently selected from linear or branched $C_1$–$C_6$ alkyl groups;

$R_5$, $R_6$ are independently H or $CH_3$;

P is from 0 to 3;

q is 0 or 1;

z is —(CO)O—, —C(O)NH—, or —O—; and $X^-$ is an appropriate counter ion,

B is siloxane-containing moiety;

n is from 1 to 50;

-b- indicates that A and B are connected via the termini of A and B respectively; and -g- indicates that either A or B segment is attached anywhere pendant on the B or A block respectively;

-r- indicates that A and B are polymerised to form a random copolymer; and wherein at least some of the cationic moieties A are selected from those derived from monomers (II)

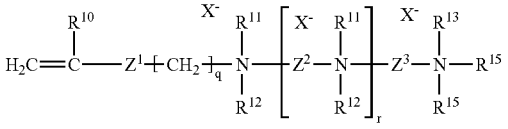

of formula (II):

in which:

each $R^{10}$, $R^{11}$, $R^{12}$, $R^{13}$ and $R^{14}$ is independently selected from alkyl, hydroxylalkyl or aminoalkyl groups in which the alkyl moiety is a linear or branched $C_1$–$C_6$ chain;

$R^{15}$ is hydrogen, methyl or ethyl;

q is from 0 to 10, r is from 1 to 6;

$Z^1$ is as defined for Z in formula (I);

$Z^2$ represents a $(CH_2)_s$ group, s being from 1 to 6;

$Z^3$ is a linear or branched $C_2$–$C_{12}$, polymethylene chain optionally interrupted by one or more heteroatoms or heterogroups, and optionally substituted by one or more hydroxyl or amino groups; and each $X^-$, is independently as defined in formula (I); and and also from ethylenically unsaturated monomers containing an aliphatic or aromatic cyclic moiety which contains a charged nitrogen ($N^+$) atom.

* * * * *